US006023860A

United States Patent [19]

McMullin

[11] Patent Number: 6,023,860

[45] Date of Patent: Feb. 15, 2000

[54] ATHLETIC SHOE CLEAT

[75] Inventor: Faris W. McMullin, Boise, Id.

[73] Assignee: Softspikes, Inc., Gaithersburg, Md.

[21] Appl. No.: 09/123,310

[22] Filed: Jul. 28, 1998

Related U.S. Application Data

[60] Provisional application No. 60/070,735, Dec. 11, 1997.

[51] Int. Cl.[7] ..... A43B 5/00; A43C 15/02

[52] U.S. Cl. ..... 36/127; 36/134; 36/59 R

[58] Field of Search ..... 36/127, 134, 59 R, 36/67 R, 67 D

[56] References Cited

U.S. PATENT DOCUMENTS

| | | | |
|---|---|---|---|
| 39,575 | 8/1863 | Hyatt et al. . | |
| 180,578 | 8/1876 | Gunsalus . | |
| D. 288,262 | 2/1987 | Yokoishi | D2/317 |
| D. 320,882 | 10/1991 | Collins | D2/314 |
| D. 327,975 | 7/1992 | Saito et al. | D2/314 |
| D. 341,479 | 11/1993 | Saito et al. | D2/314 |
| D. 341,480 | 11/1993 | Saito et al. | D2/317 |
| D. 341,704 | 11/1993 | Saito et al. | D2/962 |
| D. 341,705 | 11/1993 | Saito et al. | D2/962 |

(List continued on next page.)

FOREIGN PATENT DOCUMENTS

| | | |
|---|---|---|
| 2231216 | 9/1998 | Canada . |
| 0 153 136 | 8/1985 | European Pat. Off. . |
| 0 342 232 | 11/1989 | European Pat. Off. . |
| 0363217 | 4/1990 | European Pat. Off. . |
| 0 524 861 | 1/1993 | European Pat. Off. . |
| 493748 | 8/1919 | France . |
| 807754 | 1/1937 | France . |
| 185659 | 6/1907 | Germany . |
| 156642 | 7/1939 | Germany . |
| 2529027 | 1/1977 | Germany . |
| 2540426 | 3/1977 | Germany . |
| 3438060 | 6/1985 | Germany . |
| 4316650 | 11/1993 | Germany . |
| 467815 | 12/1951 | Italy . |
| 57-30003 | 7/1980 | Japan . |
| 762928 | 5/1989 | Japan . |
| 7-209 | 1/1995 | Japan . |
| 3027022 | 5/1996 | Japan . |
| 9-168405 | 6/1997 | Japan . |
| 6877 | of 1896 | United Kingdom . |
| 2814 | of 1914 | United Kingdom . |
| 401979 | 11/1933 | United Kingdom . |
| 1 263 960 | 2/1972 | United Kingdom . |
| 1378461 | 12/1974 | United Kingdom . |
| 1434282 | 5/1976 | United Kingdom . |
| 2004731 | 4/1979 | United Kingdom . |
| 2 053 658 | 2/1981 | United Kingdom . |
| 1587382 | 4/1981 | United Kingdom . |
| 2223394 | 4/1990 | United Kingdom . |
| 2248762 | 4/1992 | United Kingdom . |
| 2266223 | 10/1993 | United Kingdom . |
| 2322787 | 9/1998 | United Kingdom . |
| 91/03960 | 4/1991 | WIPO . |
| WO94/28750 | 12/1994 | WIPO . |
| WO97/18724 | 5/1997 | WIPO . |
| WO98/35575 | 8/1998 | WIPO . |

OTHER PUBLICATIONS

Article from Golf Digest, p. 149 (Softspikes), Dec. 1996.

*Primary Examiner*—Ted Kavanaugh

*Attorney, Agent, or Firm*—Fish & Neave; Jeffrey H. Ingerman

[57] ABSTRACT

A cleat provides traction in golf shoes (and shoes for other turf sports) without adversely affecting turf, while providing a desired level of traction under as many different conditions as possible, is resistant to being worn down on hard surfaces. The cleat has a hub with an attachment stud for attaching to a receptacle in a shoe sole, and at least one traction element extending substantially laterally from the flange to engage grass blades to provide traction without damaging turf. The traction element is deflectably attached to the hub, preferably by a resilient arm having a turf-engaging portion at the end thereof. The traction element is preferably cantilevered out of the plane of the hub, and in any event preferably deflects when a hard surface is encountered, to protect the turf-engaging portion from abrasion.

38 Claims, 28 Drawing Sheets

U.S. PATENT DOCUMENTS

| | | | |
|---|---|---|---|
| D. 341,938 | 12/1993 | Saito et al. | D2/962 |
| D. 342,151 | 12/1993 | Saito et al. | D2/962 |
| D. 342,152 | 12/1993 | Saito et al. | D2/962 |
| D. 342,373 | 12/1993 | Saito et al. | D2/962 |
| 416,861 | 12/1889 | Scafe . | |
| 485,459 | 11/1892 | Crocker . | |
| 962,719 | 6/1910 | Pratt . | |
| 982,278 | 1/1911 | Kline . | |
| 1,093,358 | 4/1914 | Schroeder . | |
| 1,243,209 | 10/1917 | Park . | |
| 1,304,616 | 5/1919 | Smith . | |
| 1,355,827 | 10/1920 | Finneran . | |
| 1,422,716 | 7/1922 | Jones . | |
| 1,749,351 | 3/1930 | McQueen . | |
| 1,876,195 | 9/1932 | Youmans . | |
| 2,258,805 | 10/1941 | Phillips | 36/59 |
| 2,336,632 | 12/1943 | Park | 36/59 |
| 2,491,596 | 12/1949 | Zaleski et al. | 36/59 |
| 2,745,197 | 5/1956 | Holt | 36/2.5 |
| 2,803,070 | 8/1957 | Passidomo et al. | 36/59 |
| 2,844,833 | 7/1958 | Odermatt | 12/146 |
| 2,895,235 | 7/1959 | Melchiona | 36/59 |
| 3,487,563 | 1/1970 | Austin | 36/67 |
| 3,512,275 | 5/1970 | Leavitt | 36/59 |
| 3,559,310 | 2/1971 | Kiela | 36/7.3 |
| 3,561,140 | 2/1971 | Ludwig | 36/59 |
| 3,583,082 | 6/1971 | Jordan, Jr. | 36/59 |
| 3,583,083 | 6/1971 | Drew | 36/62 |
| 3,656,245 | 4/1972 | Wilson | 36/67 D |
| 3,672,077 | 6/1972 | Coles | 36/2.5 T |
| 3,747,238 | 7/1973 | Jankauskas | 36/61 |
| 3,766,670 | 10/1973 | Nakajima . | |
| 3,818,617 | 6/1974 | Dassler et al. | 36/32 R |
| 3,859,739 | 1/1975 | Dassler | 36/67 D |
| 3,890,725 | 6/1975 | Lea et al. | 36/11.5 |
| 4,014,114 | 3/1977 | Jordan et al. | 36/67 D |
| 4,141,158 | 2/1979 | Benseler et al. | 36/32 R |
| 4,180,923 | 1/1980 | Dassler | 36/32 R |
| 4,205,466 | 6/1980 | Collins | 36/67 D |
| 4,233,759 | 11/1980 | Bente et al. | 36/59 R |
| 4,299,038 | 11/1981 | Epple | 36/67 D |
| 4,309,376 | 1/1982 | Ueno et al. | 264/241 |
| 4,330,950 | 5/1982 | Reddien | 36/127 |
| 4,366,632 | 1/1983 | Bente | 36/67 D |
| 4,375,728 | 3/1983 | Dassler . | |
| 4,392,312 | 7/1983 | Crowley et al. | 36/67 R |
| 4,492,047 | 1/1985 | Arff | 36/134 |
| 4,521,979 | 6/1985 | Blaser | 36/29 |
| 4,527,345 | 7/1985 | Lopez Lopez | 36/127 |
| 4,571,852 | 2/1986 | Lamarche et al. | 36/32 R |
| 4,587,748 | 5/1986 | Collins | 36/127 |
| 4,633,600 | 1/1987 | Dassler et al. | 36/134 |
| 4,689,901 | 9/1987 | Ihlenburg | 36/126 |
| 4,723,366 | 2/1988 | Hagger | 36/134 |
| 4,727,661 | 3/1988 | Kuhn | 36/100 |
| 4,777,738 | 10/1988 | Giese et al. | 36/32 R |
| 4,782,604 | 11/1988 | Wen-Shown | 36/127 |
| 4,833,796 | 5/1989 | Flemming | 36/134 |
| 4,837,949 | 6/1989 | Dufour | 36/127 |
| 4,885,851 | 12/1989 | Peterson | 36/127 |
| 5,029,405 | 7/1991 | DeHaitre | 36/134 |
| 5,033,211 | 7/1991 | Latraverse et al. | 36/134 |
| 5,070,631 | 12/1991 | Fenton | 36/127 |
| 5,077,916 | 1/1992 | Beneteau | 36/114 |
| 5,259,129 | 11/1993 | Deacon et al. | 36/127 |
| 5,367,793 | 11/1994 | Deacon et al. | 36/127 |
| 5,483,760 | 1/1996 | Kataoka et al. | 36/134 |
| 5,533,282 | 7/1996 | Kataoka et al. | 36/129 |
| 5,623,774 | 4/1997 | Abbey | 36/134 |
| 5,791,071 | 8/1998 | Rosdail . | |
| 5,794,367 | 8/1998 | Carroll | 36/134 |
| 5,887,371 | 3/1999 | Curley, Jr. . | |
| 5,901,472 | 5/1999 | Adam . | |

1342
1344
1343
1342
1344
1343
1342
1344
1343

ATHLETIC SHOE CLEAT

CROSS REFERENCE TO RELATED APPLICATION

This claims the benefit of copending, commonly-assigned U.S. Provisional Application No. 60/070,735, filed Dec. 11, 1997.

BACKGROUND OF THE INVENTION

This invention relates to cleats for use with shoes worn on turf, and particularly to a golf cleat that provides enhanced traction without adversely affecting the turf, and at the same time is resistant to wear when worn on other surfaces.

The need for improved traction on turf surfaces is well known. Specialized shoes for many different sports—e.g., baseball, football, soccer and golf, among others—have structure provided on their soles to enhance traction. Taking golf as a representative example throughout the remainder of this specification, it has long been known to provide golf shoes with relatively large metal spikes for traction.

For almost as long as they have been in use, golf spikes (and similar structures provided on athletic shoes for other turf sports) have also been known to adversely affect the turf of golf courses (or other playing surfaces), and particularly putting greens. The large spikes tear into the putting green surface, particularly when a golfer drags his or her feet as many do, leaving "spike marks" that disrupt the carefully manicured surface and adversely affect the trajectories of putted golf balls. So well known are spike marks in golf that the rules of the game have been adapted to account for their presence (the rules prohibit repairing spike marks before putting). In addition to affecting players' putting, spike marks also affect groundskeepers, who after a day of play by numerous spike-wearing golfers have to spend hours repairing the various putting greens on their golf courses.

In addition to the annoyance to players and groundskeepers caused by the marks that they leave, traditional golf shoe spikes also affect the health of grass all over the golf course, not only on greens. First, the spikes penetrate a significant distance into the ground, frequently damaging a portion of the grass plant above the roots, known as the "crown." Damage to the crown often kills the plant. Second, the spikes pick up seeds of undesirable plants—including weeds and grasses (e.g., *Poa annua*)—and inoculate those seeds into the greens, causing growth of undesirable plants.

Traditional metal golf spikes are also damaging to the floor surfaces of golf clubhouses, and may actually exacerbate slipping on certain clubhouse floor surfaces such as marble. Traditional metal golf spikes even cause damage to paved outdoor walkways.

One known solution to the problems caused by traditional golf spikes is shown in commonly-assigned U.S. Pat. Nos. 5,259,129 and 5,367,793, which are hereby incorporated by reference in their entirety. Those patents show a golf cleat that attaches to the same golf shoe fittings designed for traditional spikes. The cleat is preferably made from a plastic material having a preferably convex lower surface bearing a plurality of ribs that distribute the golfer's weight to produce a plurality of gripping forces—which are mainly frictional—in a plurality of directions, without puncturing the turf, thereby reducing the adverse affects described above.

Cleats such as those described in the aforementioned patents recently have become increasingly popular. Other nonmetallic alternatives to metal spikes, having different types of ribs or protrusions, have also come into use.

One drawback of nonmetallic spike alternatives has been that, because the cleats are worn not only on the turf portions of the golf course, but also on paved walkways and other hard surfaces, the ribs or protrusions that provide the traction on turf are gradually abraded away by the hard surfaces, much faster than they would be if worn exclusively while walking on turf. As a result, the ability of the cleat to provide traction is reduced or destroyed, and the cleat must be replaced sooner than if it were worn exclusively on turf.

One solution to this wear problem is shown in copending, commonly-assigned U.S. patent application Ser. No. 08/823,901, filed Mar. 25, 1997. The cleat shown there has a flange with an attachment stud for attaching to a receptacle in a shoe sole, a plurality of traction protrusions on the flange to engage grass blades to provide traction without damaging turf, and a bearing portion that bears the wearer's weight, particularly when the wearer walks on a hard surface. In the preferred embodiment shown, the bearing portion is a dome-shaped central portion. The protrusions are thereby less affected by the abrading effects of the hard surface, and last longer before they are worn to the point that they must be replaced.

In all of the foregoing cleats, however, if one of the traction elements encounters a hard surface, it will be abraded. It would be desirable to be able to provide an athletic shoe cleat having traction elements whose abrasion when worn on hard surfaces is minimized.

It would also be desirable to provide such a cleat having enhanced traction.

SUMMARY OF THE INVENTION

It is an object of this invention to provide an athletic shoe cleat having traction elements whose abrasion when worn on hard surfaces is minimized.

It is also an object of this invention to provide such a cleat having enhanced traction.

In accordance with the present invention, there is provided a removable cleat for use with an athletic shoe for providing to a user traction on a turf surface. The athletic shoe has a sole, and the sole has a plurality of sole attachment means for attachment of removable cleats. Each removable cleat comprises a hub having a first side facing the sole and a second side facing away from the sole. A hub attachment means extends from the first side for attaching the hub to one of the sole attachment means. At least one traction element extends substantially laterally from the hub. The traction element has a turf-engaging portion projecting away from the second side of the hub for engagement with turf blades to provide traction without puncturing turf. The traction element is deflectably attached to the hub so that the turf-engaging portion deflects when it encounters a hard surface, to minimize wear of the turf-engaging portion by the hard surface.

An athletic shoe incorporating such cleats is also provided.

By "substantially without puncturing the turf" is meant that the turf-engaging portion extends into and engages the grass blades of the turf, but does not penetrate into the ground or, if it does penetrate into the ground on certain types of turf surfaces (such as closely cropped greens), penetrates into the ground only a negligible amount insufficient to significantly damage the grass plant. What is important is that the crown of the grass plant not be damaged.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
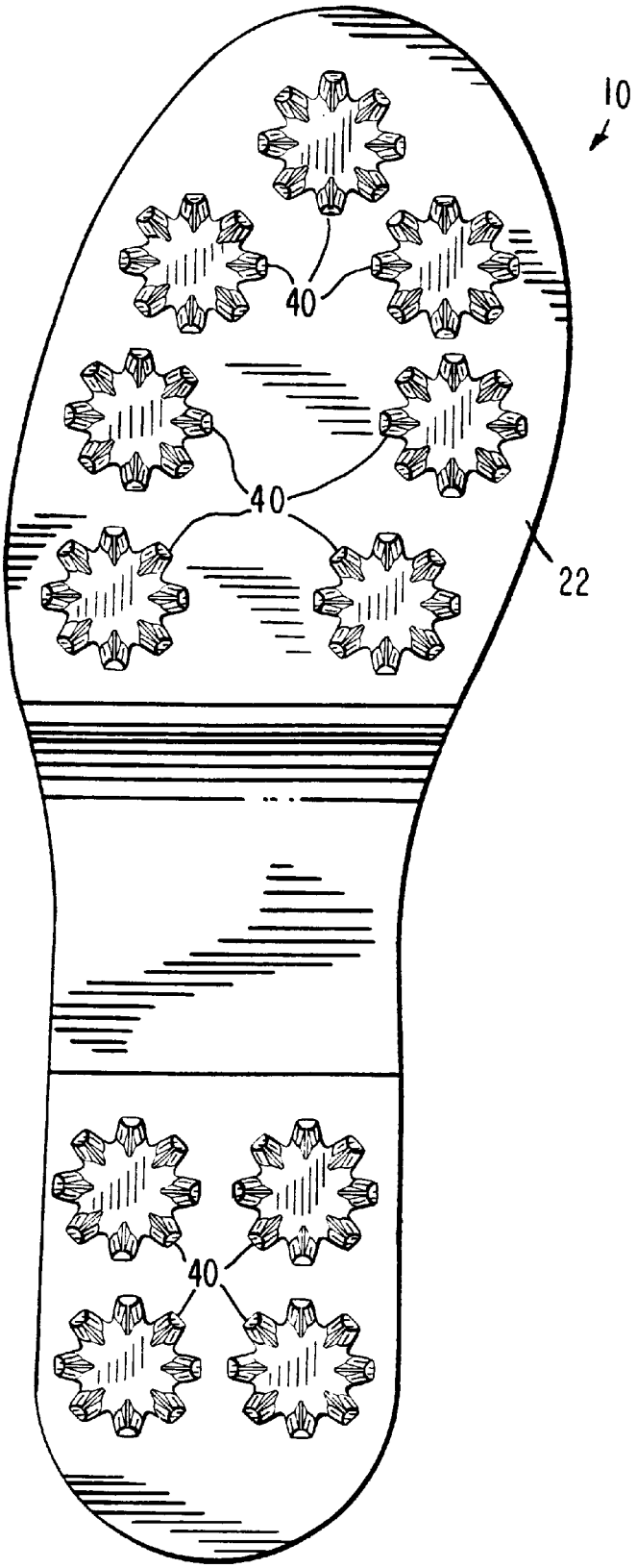
FIG. 1 is a plan view of the underside of an athletic shoe incorporating a first preferred embodiment of a cleat according to the present invention.

In accordance with the present invention, traction is provided for athletic activities on turf surfaces by providing an athletic shoe having cleats, each of which has a hub with at least one traction element extending substantially laterally from the hub. The cleat also preferably includes a threaded stud or shaft or other attachment device which may be integral with, or removable from, the central hub, for attaching the cleat to a corresponding threaded or other socket in the sole of an athletic shoe. Each traction element preferably acts substantially independently from other traction elements, if any, although adjacent traction elements, if any, may cooperate to provide traction.

Each traction element preferably has a turf-engaging portion for engagement with grass blades in the turf to provide traction. Further, each traction element preferably is deflectably mounted to the hub, so that on a hard surface, the turf-engaging portion of the traction element is deflected, to reduce wear of the traction-engaging portions. Although the entire cleat, including the hub, may be made from a single material capable of deflection, the turf-engaging portion could be made from a more abrasion-resistant material. For example, most of the cleat could be made of polyurethane or another flexible, durable elastomer, while the turf-engaging portion is made from a "filled elastomer"—i.e., an elastomer (such as the same elastomer as the remainder of the cleat) filled with, e.g., particulate material, to make it more abrasion-resistant. The two materials could, for example, be co-molded to form the cleat. Similarly, the hub could be made from yet another material.

The traction element preferably extends substantially laterally from the hub—i.e., the projection of the traction element into the plane of the hub, which when the cleat is attached to a shoe is parallel to the plane of the shoe sole, is larger than the projection of the traction element into a plane perpendicular to that of the shoe sole. Indeed, in some embodiments, the traction element may lie substantially in the plane of the hub, so that it lies substantially along the sole when the cleat is attached to the shoe.

It is preferred that the traction element include a preferably substantially resilient arm extending from the hub, and a turf-engaging portion at the end of the arm, although the turf-engaging portion could begin at the hub, or could be integral with the arm rather than being a distinct portion. The turf-engaging portion would preferably extend generally perpendicularly to the plane of the hub, so that it extends downward between the grass blades when the cleat is attached to a shoe being worn on turf, although it may extend at some other angle. In an embodiment where the arm lies substantially against the shoe sole, the arm is preferably at least torsionally resilient, so that the turf-engaging portion can deflect away from a hard surface by "rolling" onto its side as the arm twists when a hard surface is encountered. Alternatively, when the arm lies substantially against the shoe sole, the turf-engaging portion can fold against-the sole when it encounters a hard surface, by virtue of the resilient nature of the material from which it is made.

In a more particularly preferred embodiment, the traction element does not lie substantially in the plane of the hub. Rather, while the projection of the traction element into the plane of the hub is larger, the traction element nevertheless has a significant projection perpendicular to that plane. In other words, when the cleat is attached to a shoe, the traction element is cantilevered away from the shoe sole, with the turf-engaging portion extending from the end of the traction element substantially perpendicularly to the shoe sole. It is particularly preferred that in the cantilevered embodiment, the traction element include the aforementioned arm, with the turf-engaging portion attached to the end of the arm.

Although it is within the invention for each cleat to have a single traction element with a single turf-engaging portion, as described below, it is preferred that there be a plurality of traction elements, each having a turf-engaging portion.

When a user wears the cantilevered embodiment in deep grass or turf, the traction elements can extend deeply into the turf for better traction, while still not penetrating the ground or the crowns of grass plants, and yet on a closely-cropped green, the cantilevered arms can deflect against the shoe sole to minimize the projection of the traction elements, thereby minimizing puncturing of the ground and reducing marking on the green. Moreover, on hard surfaces, the deflection of the arms against the sole dissipates energy that otherwise would go into erosion or abrasion of the turf-engaging portions, and at the same time provides traction on the hard surface, minimizing slippage.

Preferably, gussets are provided between the turf-engaging portions and the arms of the traction elements. The gussets, which are preferably resilient, preferably act as springs to pull the turf-engaging portions back into their upright positions when the arms resume their cantilevered position as the user lifts his or her foot from the hard surface or returns to a turf surface. In addition, each gusset preferably acts as a wear surface when the arms are deflected against the shoe sole, so that even the sides of the turf-engaging portions are substantially protected from abrasion. For this reason, the gussets preferably are provided on the side of the turf-engaging portion facing the hub.

The turf-engaging portions preferably are small prisms, cones, etc., which hang down between the grass blades and provide traction by interacting with the blades to resist lateral motion relative to the blades. However, the cleat according to the present invention may also provide traction by the cooperation of each pair of adjacent traction elements, as the V-shaped "notch" between them traps grass when the user's foot moves through the grass. Moreover, in the particularly preferred cantilevered embodiment, traction may also be provided as grass blades are trapped between the shoe sole and the cantilevered arm as the arm bends toward the sole (even on grass this bending will occur to some degree), mechanically locking the shoe to the grass. As the user lifts his or her foot, the arms spring outward, releasing the hold on the grass blades just at the time that the user no longer desires to be locked in place.

Finally, in the cantilevered embodiment, the continual flexing of the arms preferably results in a self-cleaning action that removes debris that otherwise could clog the cleat and reduce its ability to provide traction. In addition, a clogged cleat would be more likely to leave an undesirable indentation in the turf, especially on golf greens. The self-cleaning action thus further minimizes the damage to greens by the cleats of the invention.

The invention will now be described with reference to FIGS. 1–25.

Figure 2:
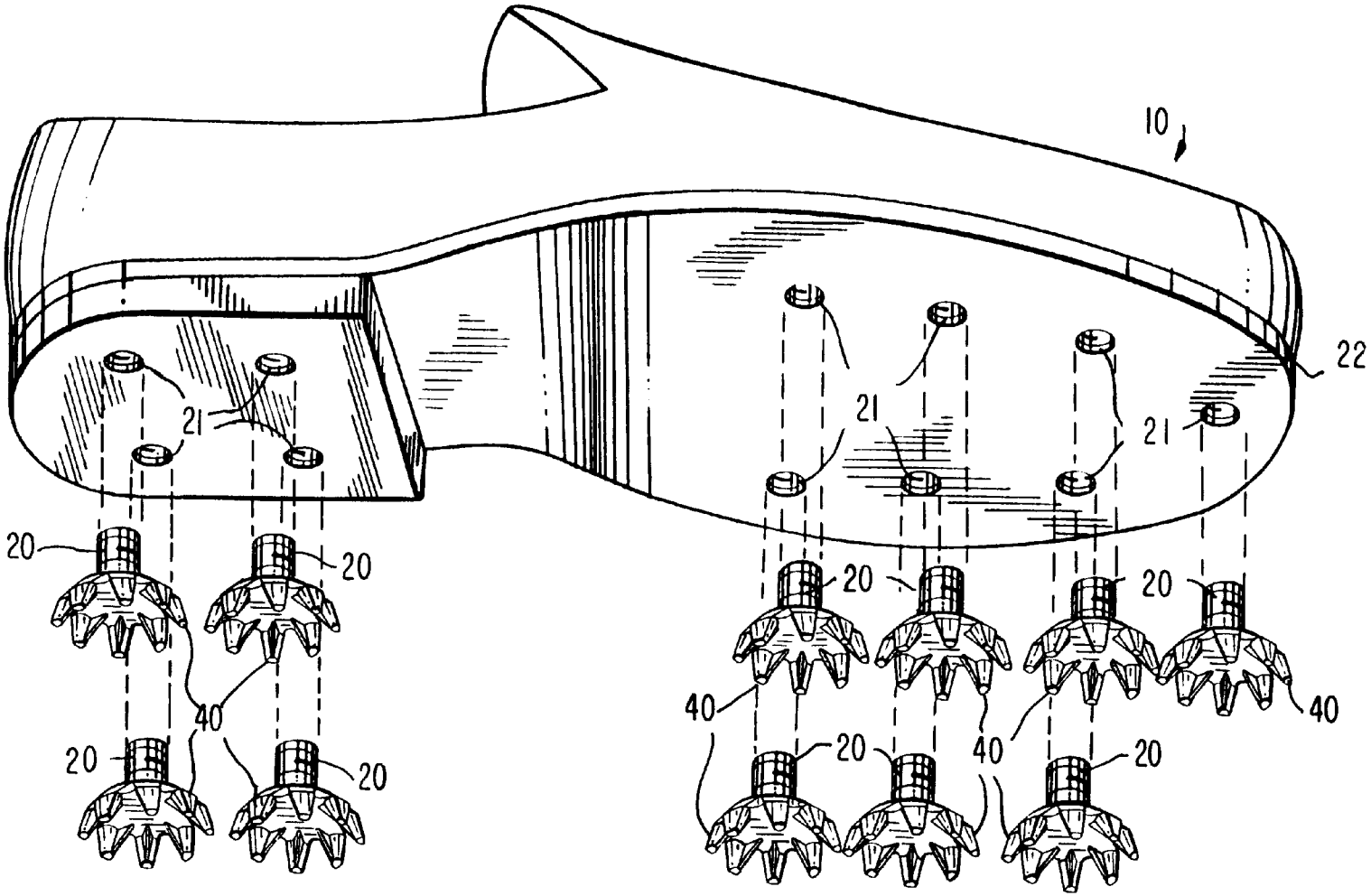
FIG. 2 is an exploded bottom perspective view of the athletic shoe of FIG. 1.
Figure 3:
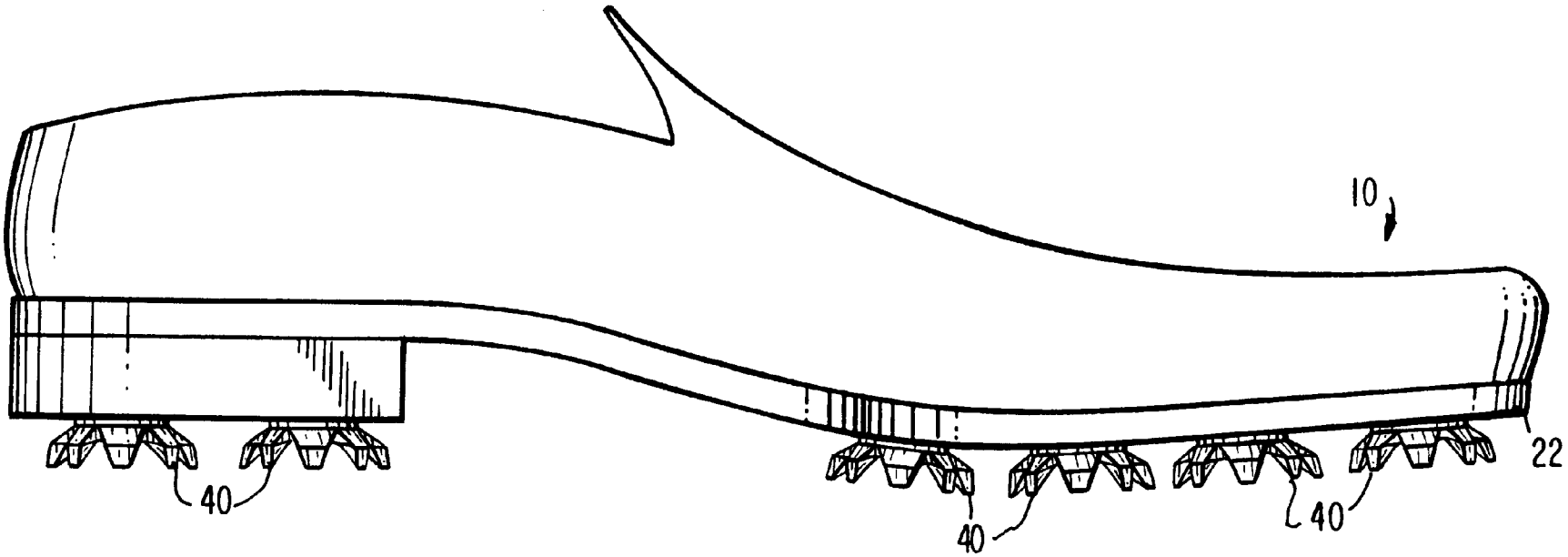
FIG. 3 is a side elevational view of the athletic shoe incorporating the first preferred embodiment of the cleat according to the present invention.

FIGS. 1–3 show a shoe 10 bearing a plurality of cleats 40 according to the present invention. As shown, there are preferably eleven cleats 40, although any other number may be provided. Each cleat 40 preferably has an attachment stud 20, which preferably is threaded for attachment to shoe 10 via one of threaded sockets 21, preferably provided for this purpose in shoe sole 22. Of course, other types of attachment could be provided.

Figure 4:
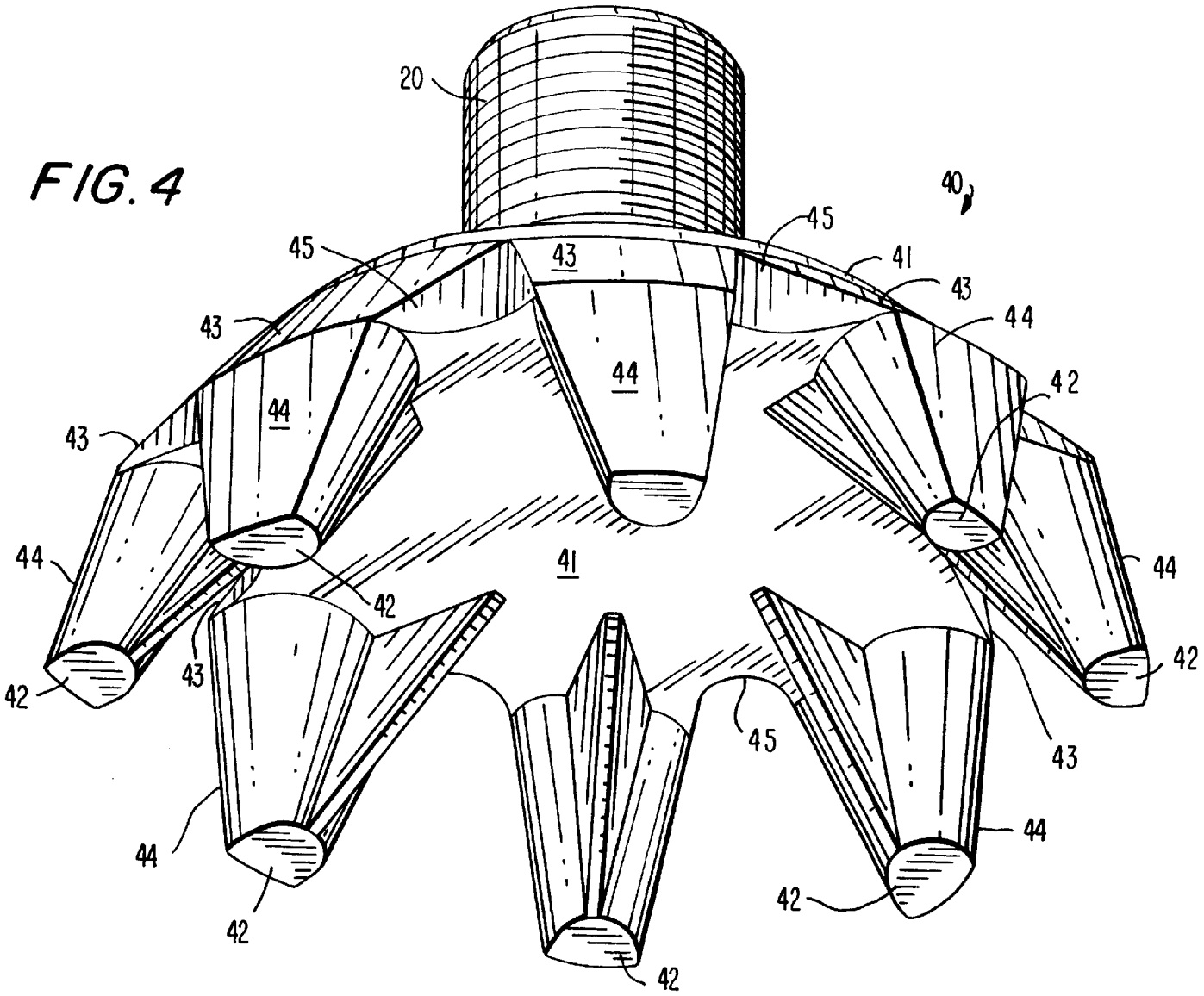
FIG. 4 is a bottom perspective view of a first preferred embodiment of a cleat according to the present invention.
Figure 5:
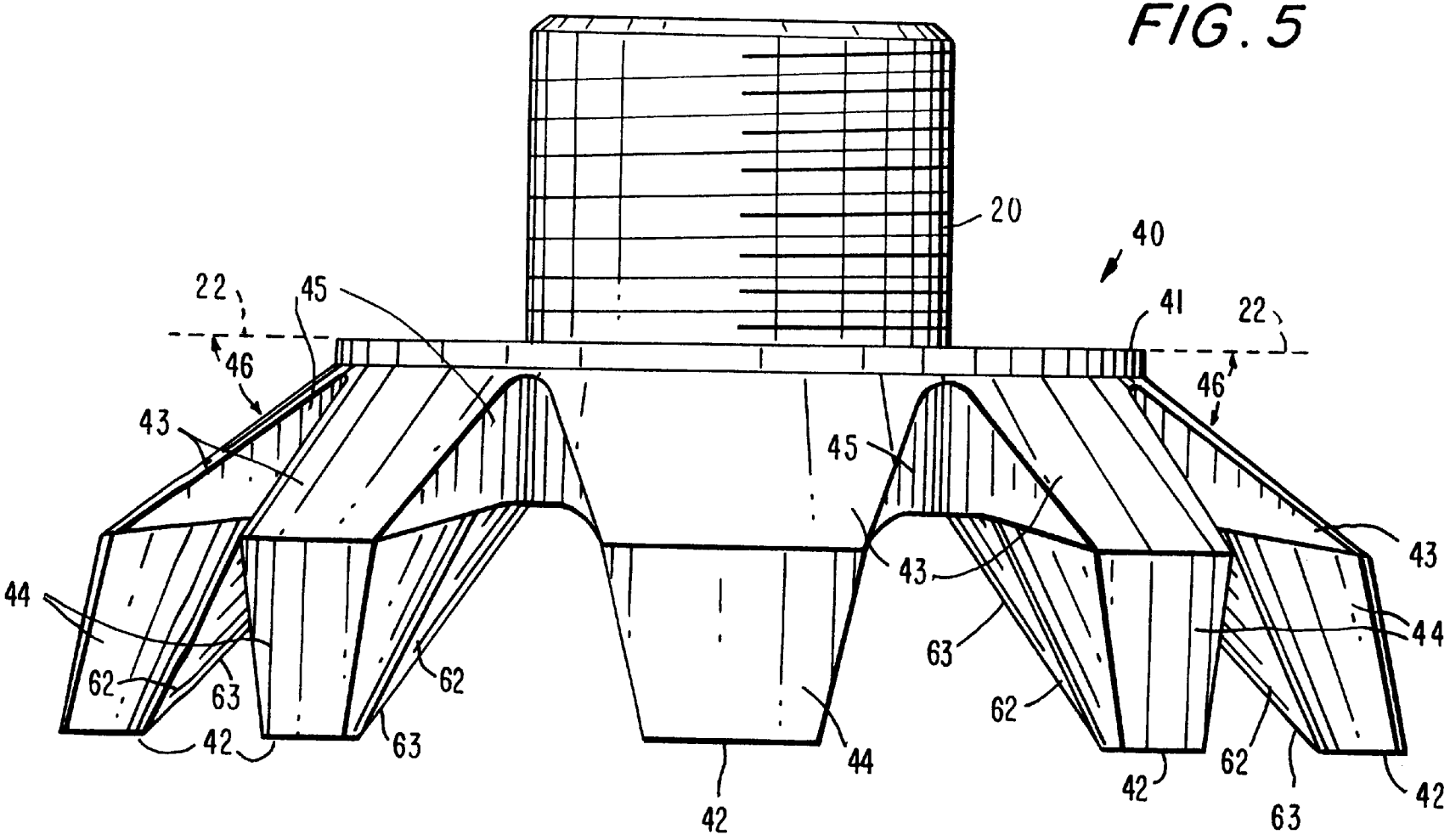
FIG. 5 is a side elevational view of the cleat of FIG. 4.
Figure 6:
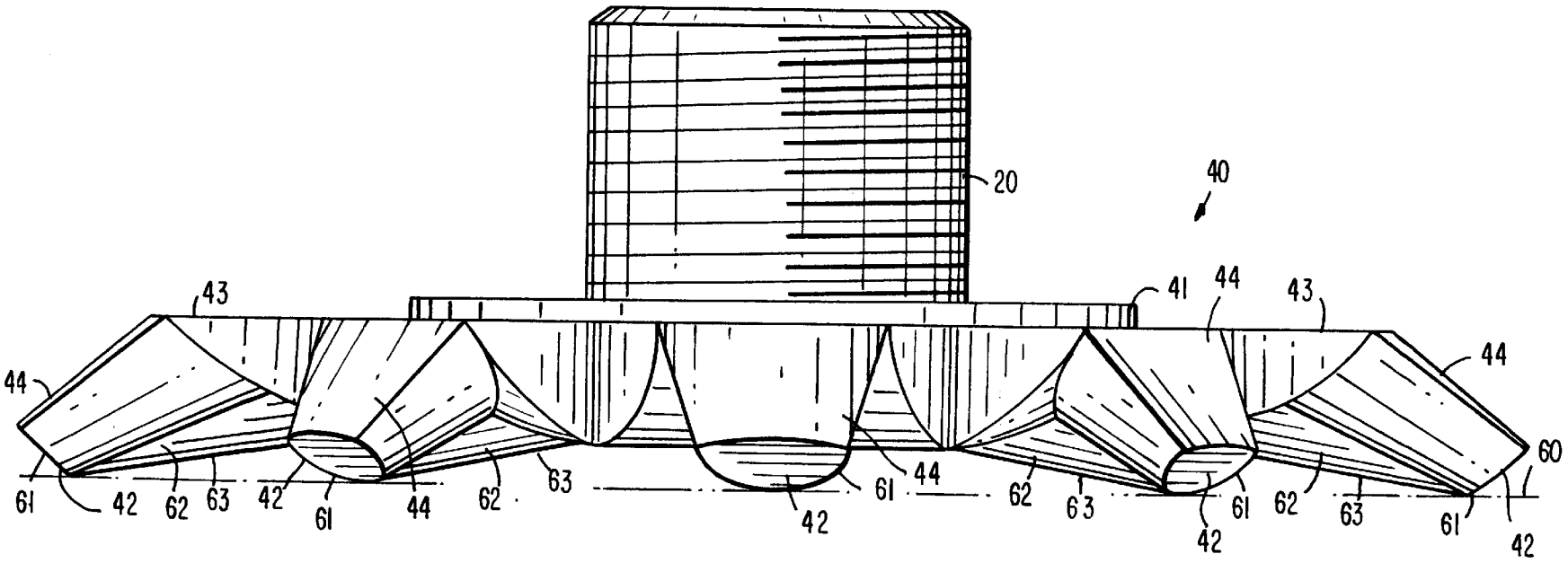
FIG. 6 is a side elevational view of the cleat of FIGS. 4 and 5 compressed against a hard surface.

Cleat 40 is shown in more detail in FIGS. 4–6. In addition to stud 20, discussed above, each cleat 40 preferably has a preferably circular hub 41 bearing a plurality of traction elements 42 of the type described above, which preferably extend substantially laterally from hub 41—i.e., their projections in the plane of hub 41 are larger than their projections in a plane perpendicular to the plane of hub 41. As shown in FIGS. 1–6, each traction element 42 preferably includes an arm 43 and a turf-engaging portion 44. Traction elements 42 are preferably mounted deflectably to hub 41, so that traction elements 42 can deflect when they encounter a hard surface such as a paved surface or even a closely cropped golf green or other closely cropped grass surface. Where, as in FIGS. 1–6, traction elements 42 include arms 43 separate from the turf-engaging portions 43, preferably at least the arms are deflectably mounted to hub 41. Most preferably, arms 43 are made from a resilient material such as polyurethane or other flexible elastomer. Turf-engaging portions 44 can be made from the same material as arms 43, provided that the material is sufficiently durable, or at least a portion, such as tip 61, of turf-engaging portions 44 can be made from a more abrasion-resistant material such as a filled elastomer as described above. When turf-engaging portions 44 are made from a different material than arms 43, turf-engaging portions 44 preferably are co-molded with arms 43. Similarly, hub 41 could be made from the same material as arms 43, or could be a different material. Preferably, however, cleat 40 is made entirely from a single material such as polyurethane or other flexible, durable elastomer, from which it is preferably made by injection molding.

Traction elements 42 provide traction on turf preferably by the interengagement of turf-engaging portions 44 with the individual grass blades without penetrating or puncturing the crown of any individual grass plant of the turf, and without penetrating or puncturing the soil. Turf-engaging portions 44 preferably extend down between the grass blades and preferably are restrained by the grass blades themselves against lateral motion, thereby providing traction. Because of the deflectable mounting of traction elements 42, turf-engaging portions 44 can be allowed to protrude further into the grass blades than previously known non-penetrating athletic shoe cleats, while nevertheless avoiding or minimizing damage to the turf.

Another component of the traction provided by cleat 40 is the result of the trapping or jamming of grass blades into the substantially V-shaped notches 45 between traction elements 42. Still another component is the result of the trapping or jamming of grass blades into the V-shaped spaces 46 between traction elements 42 and the sole of shoe 10. This latter mechanism also provides enhanced traction on closely cropped grass surfaces as described below in connection with FIG. 6.

FIG. 6 shows how the "cantilevered" embodiment of FIGS. 1–6 both provides enhanced traction on closely-cropped surfaces while reducing turf damage, and also avoids excessive wear when worn on hard surfaces. As seen in FIG. 6, when a hard surface 60 is encountered, arms 43 preferably deflect until they are substantially parallel to the plane of hub 41 and the sole of shoe 10. This deflection minimizes the abrasion of tips 61 of turf-engaging portions 44, maximizing their useful life. Moreover, the deflection of traction elements 42 absorbs energy that otherwise would go into abrasion of tips 61.

A respective gusset 62, preferably of the same resilient material as arm 43, preferably is provided between arm 43 and turf-engaging portion 44 to act as a spring to help return turf-engaging portion 44 to its upright position once it is removed from hard surface 60. By placing each gusset 62 preferably on the side of turf-engaging portion 44 facing hub 41, the gusset 62 can be made to function as a wear surface 63, protecting even the sides of turf-engaging portions 44 and thus further extending their life. In addition, because traction elements 42 are urged against hard surface 60 as they attempt to spring back, then assuming an appropriately resilient material, they, or the edges of gussets 62 if provided, could provide traction against the hard surface The position assumed by traction elements 42 in FIG. 6 can also be the result of encountering a closely cropped grass surface such as a golf green. As turf-engaging portions 44 begin to encounter the ground under the grass blades, traction elements 42 deflect as shown, minimizing penetration of the turf and damage to the grass plants and the manicured surface of the green. In addition, a further component of traction is provided as grass blades are trapped between the shoe sole and traction elements 42. The blades are released when the user picks up his or her foot, just when the traction is no longer desired. This component of traction may occur on other grass surfaces as well, to the extent that there may be some deflection of traction elements 42 even on those surfaces.

Cleat 40 as shown in FIGS. 1–6 includes threaded stud 20 as an integral part of the cleat. However, the threaded attachment may be provided as a separate element—e.g., a conventional screw—with a suitable hole provided in hub 41 through which the screw may be inserted into threaded socket 21 in shoe sole 22. The embodiments shown in FIGS. 7–24 are of the latter type. However, it should be understood that just as cleat 40 of FIGS. 1–6 could be provided with a separate threaded attachment, so too can the embodiments of FIGS. 7–24 be provided with an integral threaded stud.

Figure 7:
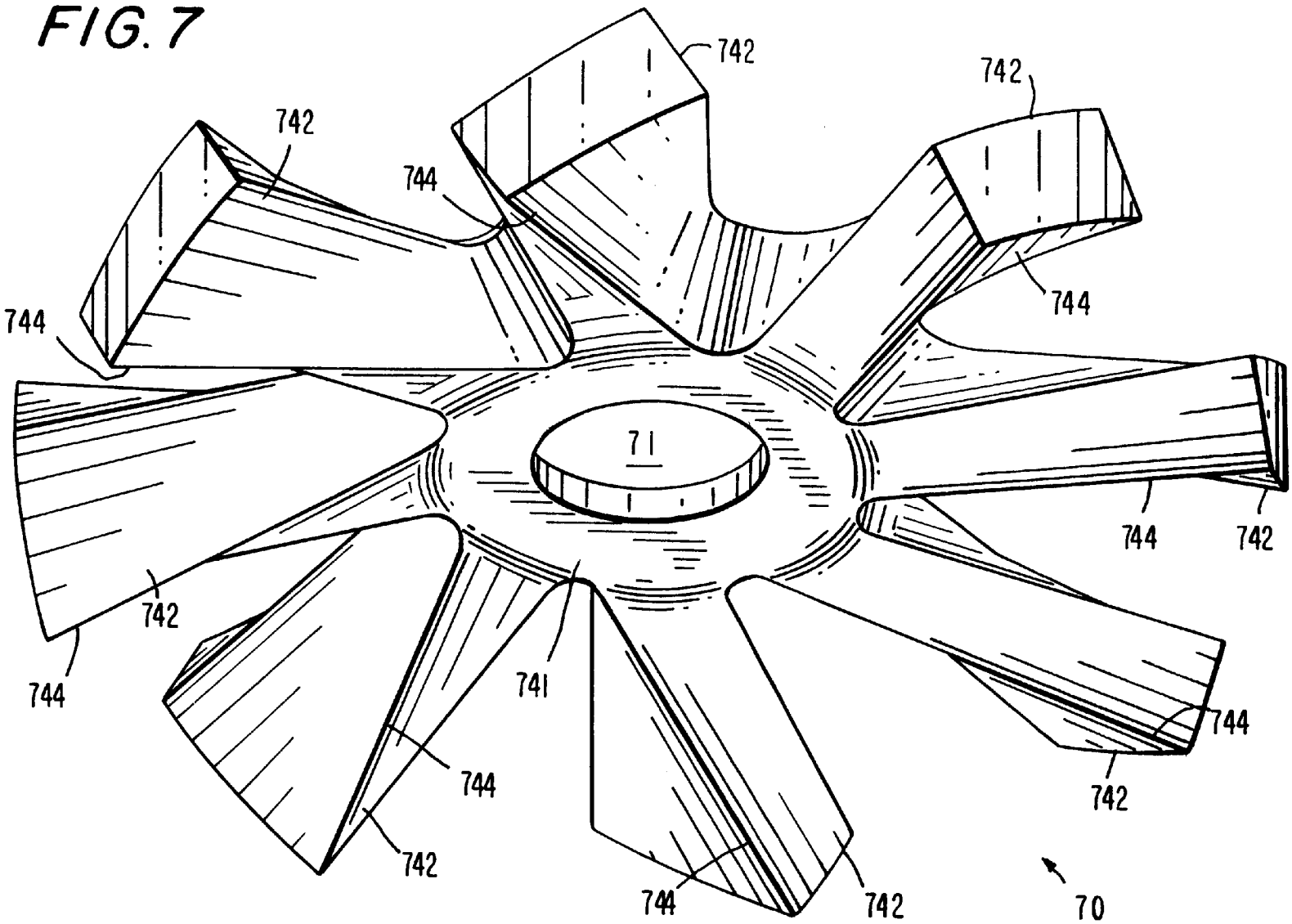
FIG. 7 is a bottom perspective view of a second preferred embodiment of a cleat according to the the present invention.
Figure 8:
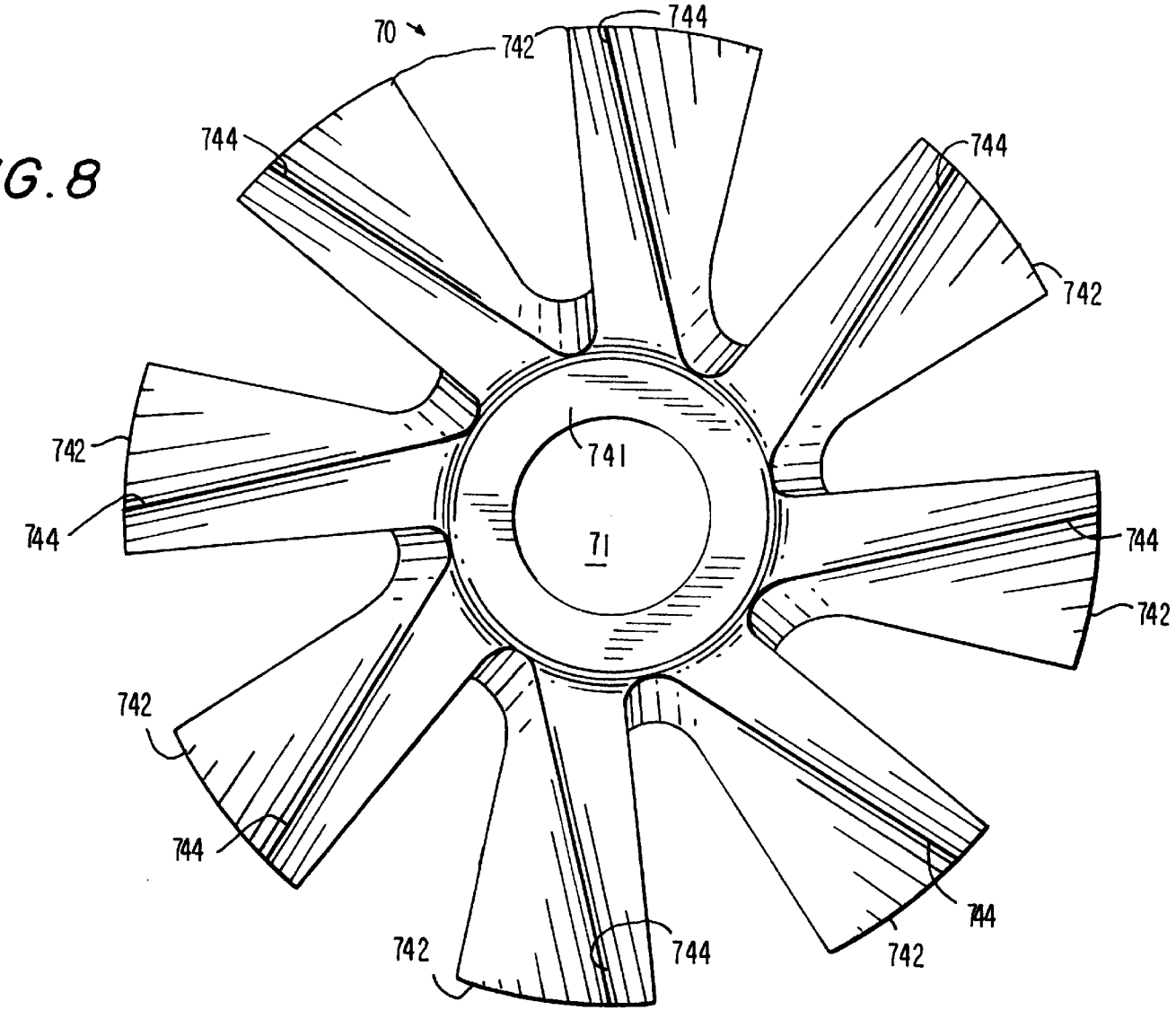
FIG. 8 is a bottom plan view of the cleat of FIG. 7.
Figure 9:
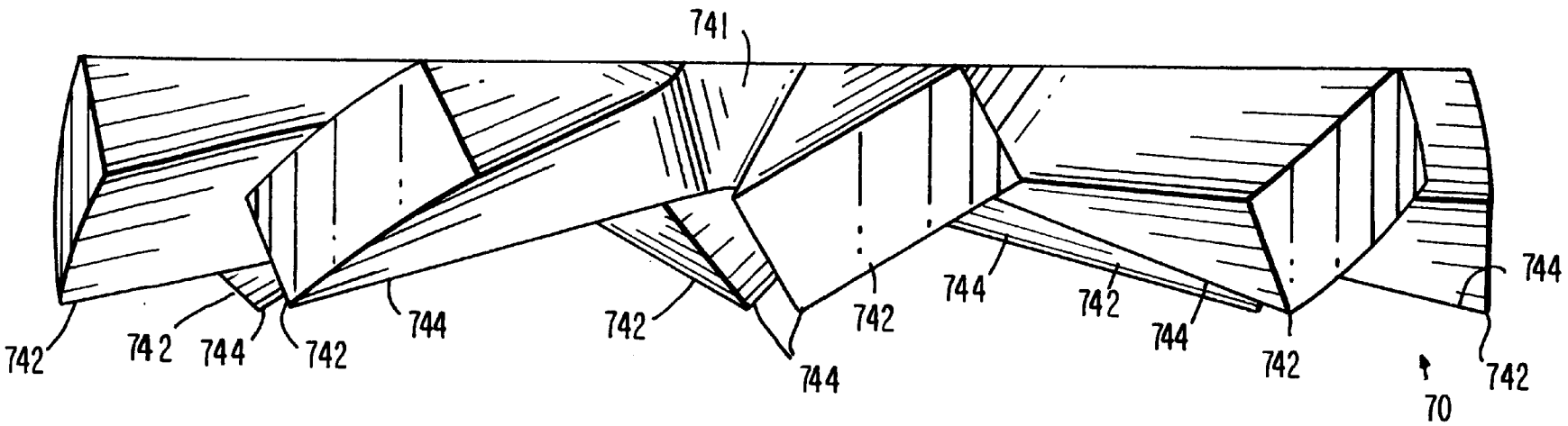
FIG. 9 is a side elevational view of the cleat of FIGS. 7 and 8.

Cleat 70, shown in FIGS. 7–9, has a hub 741 and plurality of traction elements 742 extending substantially in the plane of hub 741, so that when cleat 70 is installed in a shoe, traction elements 742 would lie substantially against the shoe sole (not shown), rather than being cantilevered. Hub 741 has a hole 71 therein for insertion of a threaded attachment, such as a screw; as set forth above, an integral threaded stud could also be provided. In addition to being of the type that is not cantilevered, each traction element 742 lacks a separate arm and turf-engaging portion. Rather, each traction element 742 is a unitary traction element that is substantially rectangular, and is twisted out of the plane of hub 741. The leading edge 744 of each traction element 742 serves as the turf-engaging portion. Although traction elements 742 lie against the sole of the shoe to which cleat 70 is attached, each traction element 742 nevertheless can deflect torsionally when a hard surface is encountered, to reduce wear of leading edge 744 and to minimize the penetration of leading edge 744 into the turf. It will be understood that traction elements like traction elements 742, which are not separated into an arm and a turf-engaging portion, also can be used in a cleat (not shown) in which the traction elements are cantilevered out of the plane of the hub.

Figure 10:
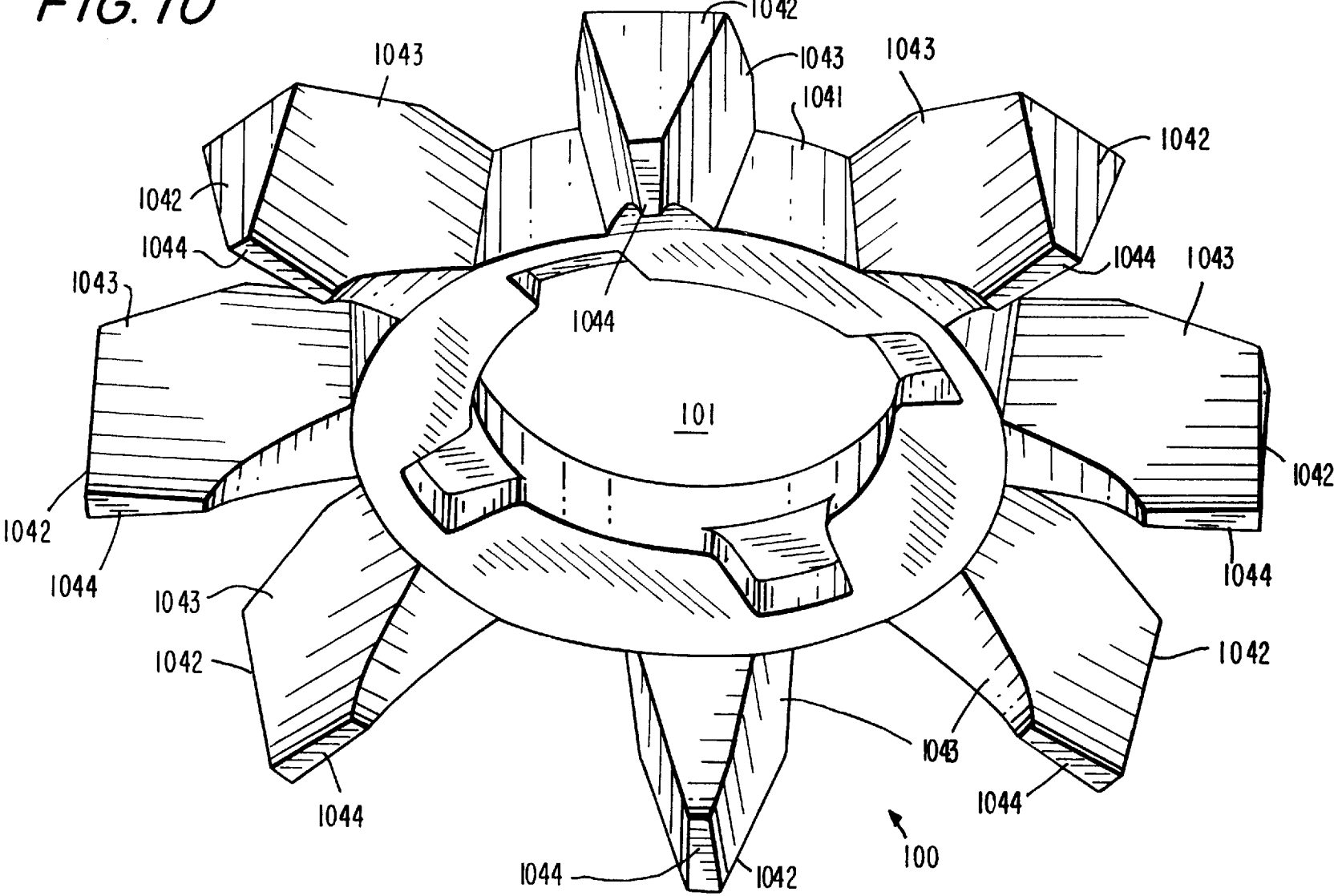
FIG. 10 is a bottom perspective view of a third preferred embodiment of a cleat according to the present invention.
Figure 11:
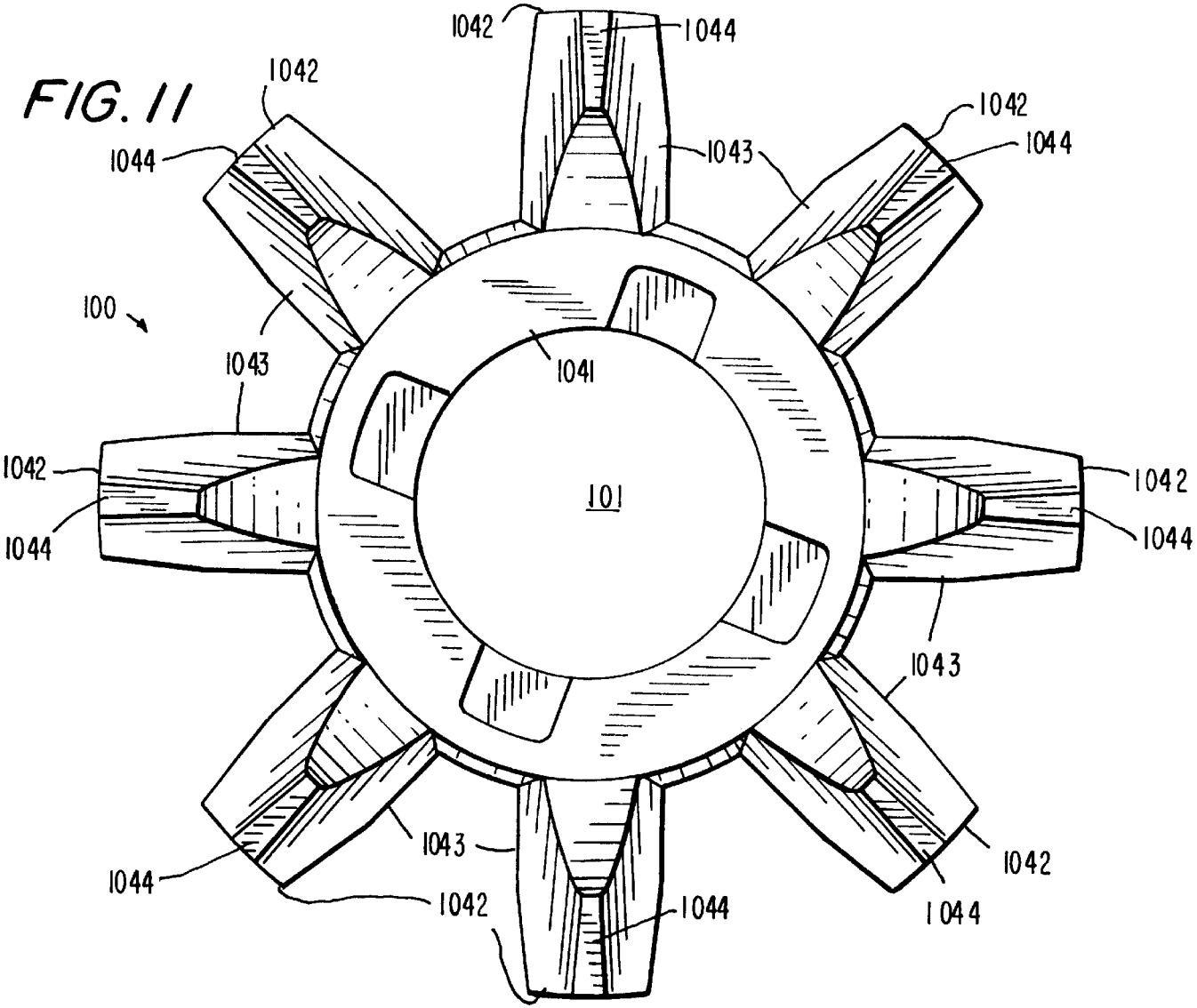
FIG. 11 is a bottom plan view of the cleat of FIG. 10.
Figure 12:
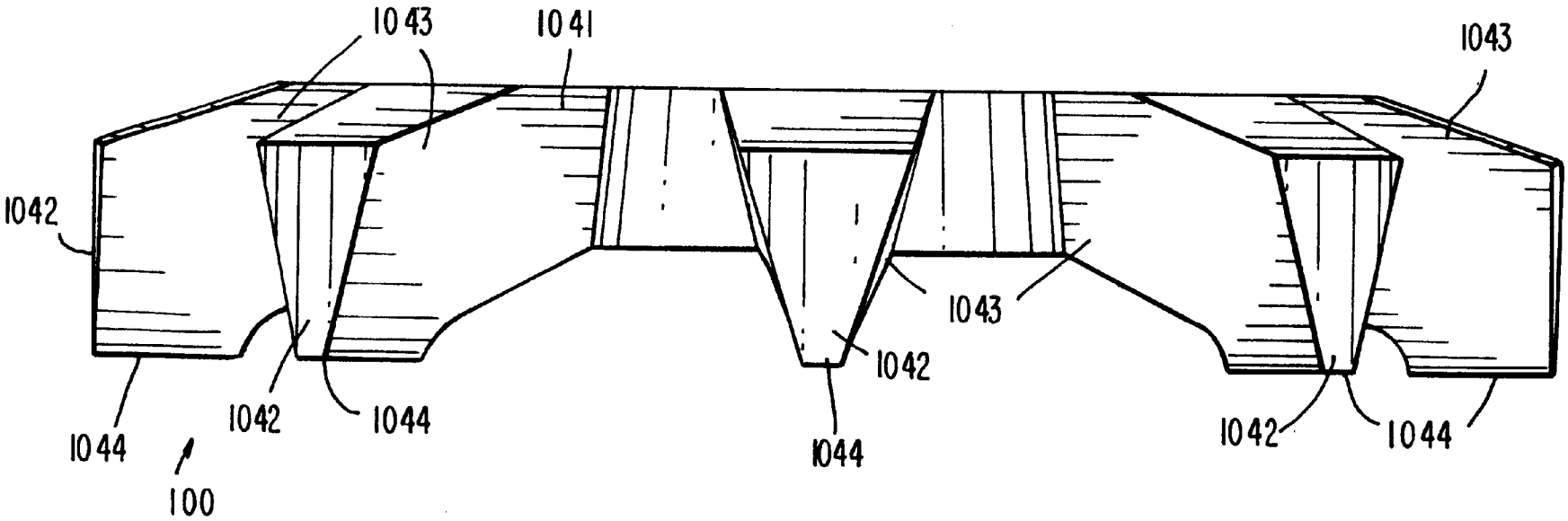
FIG. 12 is a side elevational view of the cleat of FIGS. 10 and 11.

FIGS. 10–12 are, respectively, top perspective, top plan, and side elevational views of a third preferred embodiment 100 of a cleat according to the present invention in which traction elements 1042 include turf-engaging portions 1044 resembling triangular or trapezoidal prisms having a substantially isosceles triangular cross section. Each turf-engaging portion 1044 preferably is attached to central hub 1041 by a preferably flexible arm 1043. A threaded stud or shaft (not shown), for attachment to a suitable receptacle in an athletic shoe, is formed either integrally with, or separately from but attached to, cleat 100, or a screw may be inserted through hole 101 to attach cleat 100 to a shoe.

Figure 13:
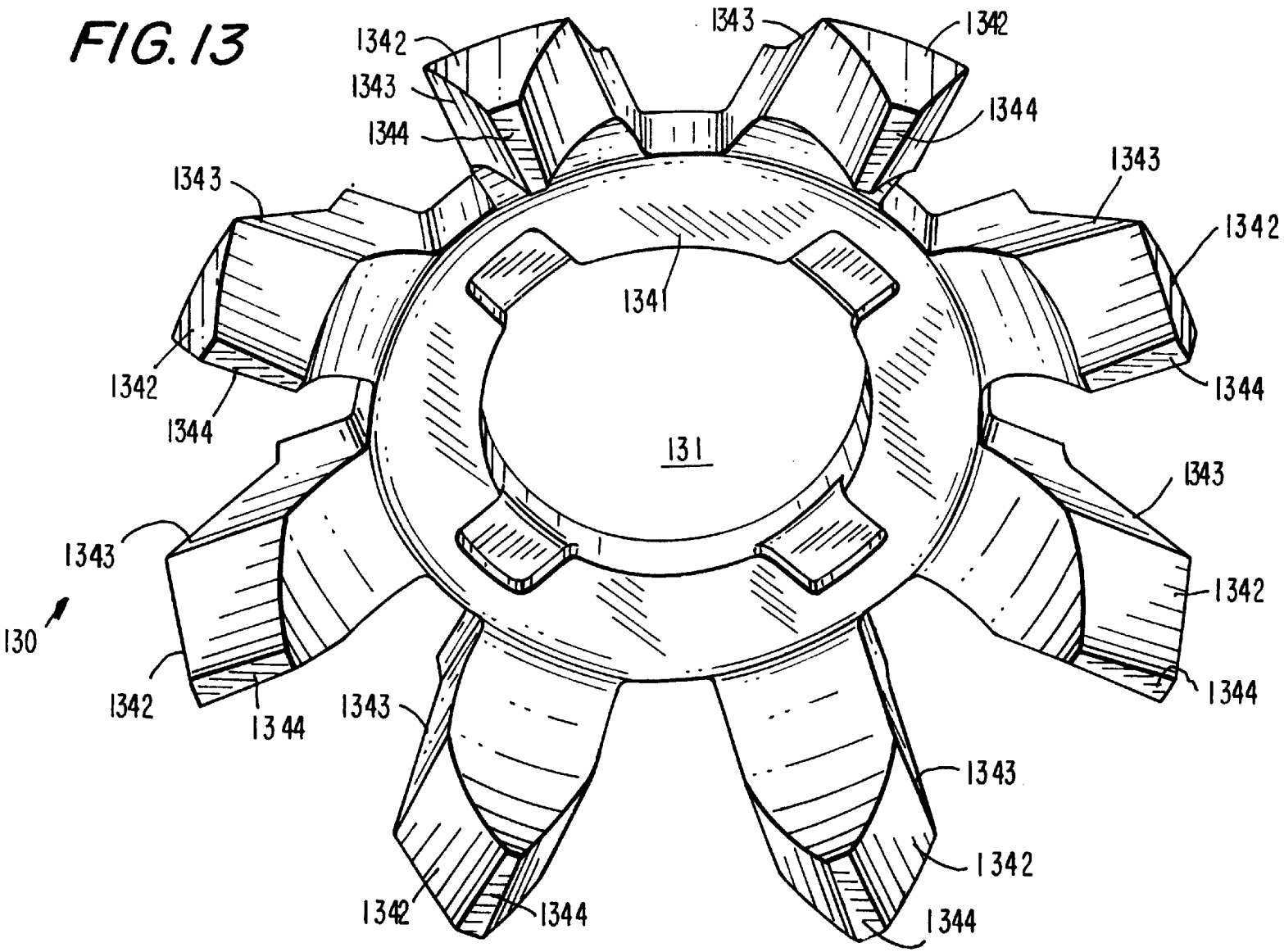
FIG. 13 is a bottom perspective view of a fourth preferred embodiment of a cleat according to the present invention.
Figure 14:
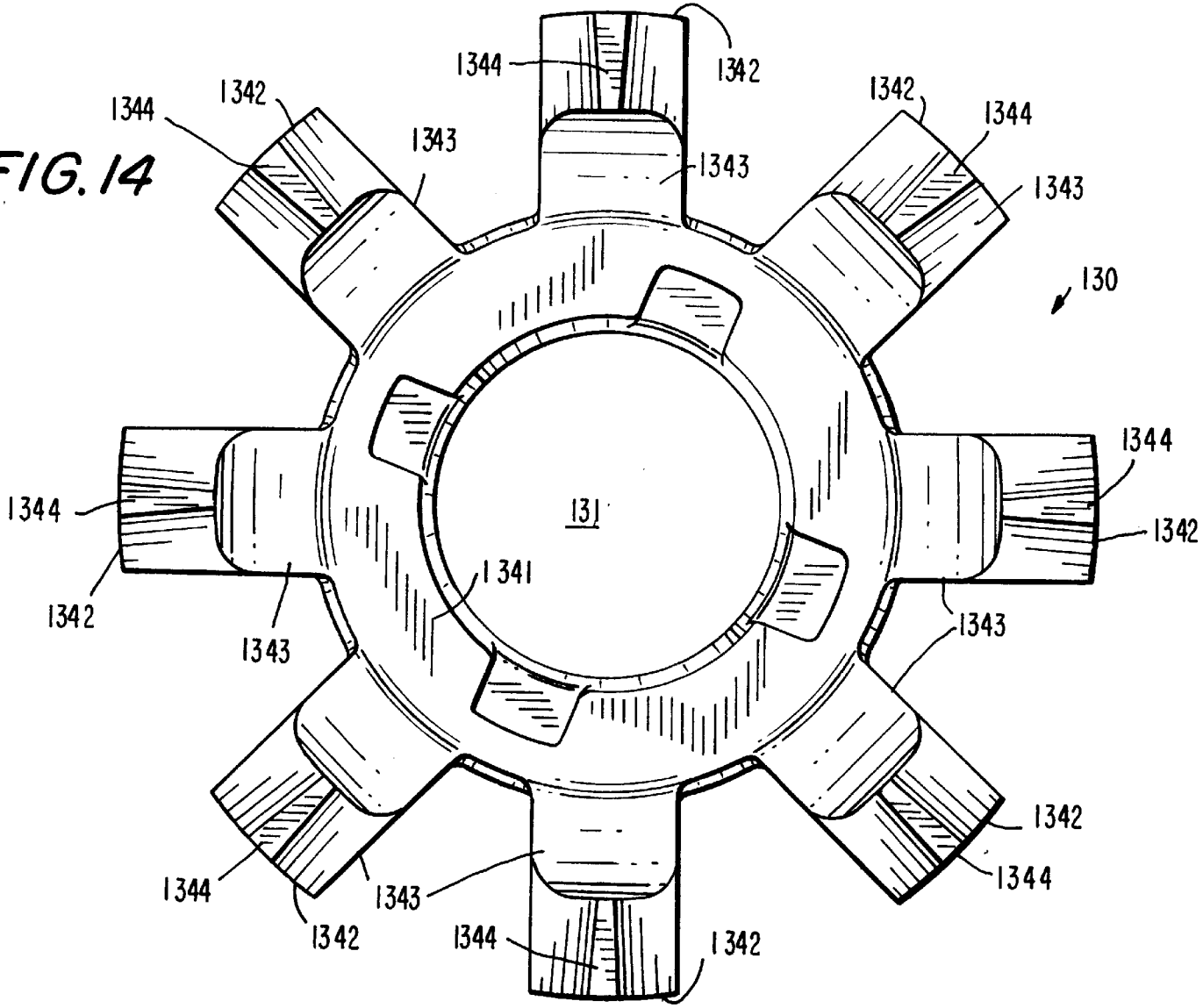
FIG. 14 is a bottom plan view of the cleat of FIG. 13.
Figure 15:
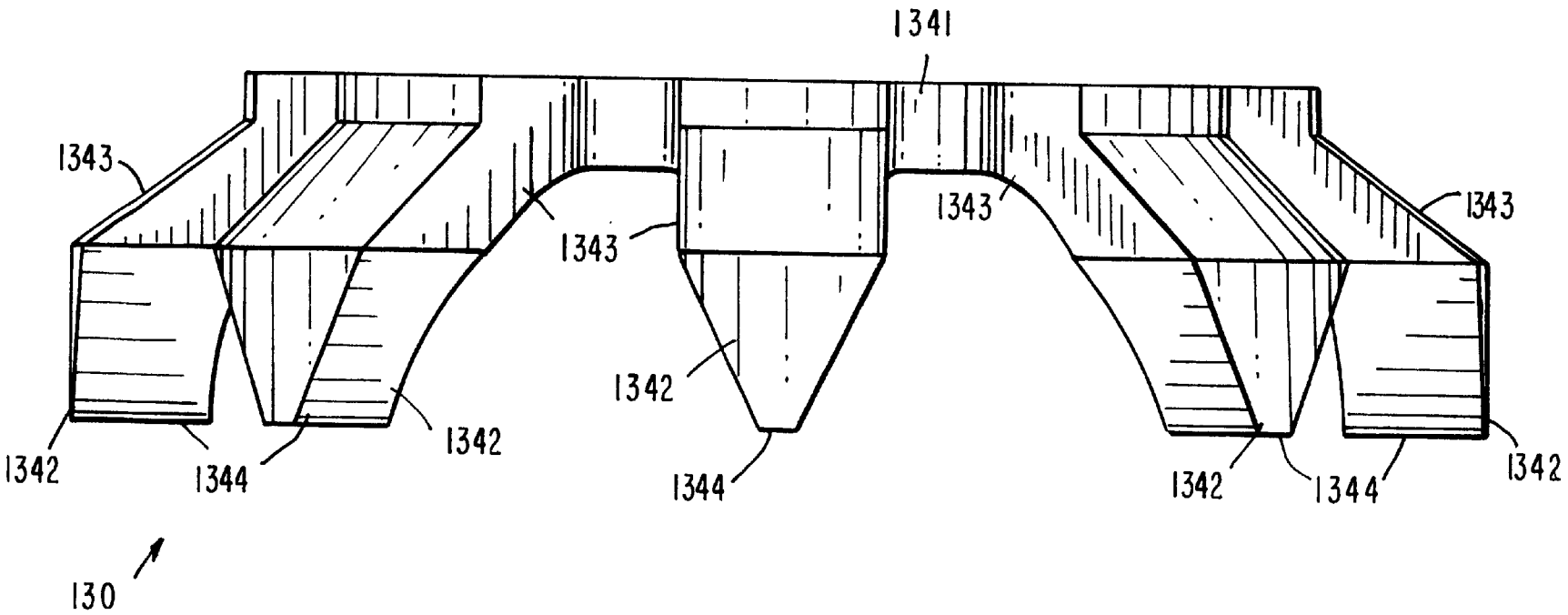
FIG. 15 is a side elevational view of the cleat of FIGS. 13 and 14.

FIGS. 13–15 are, respectively, top perspective, top plan, and side elevational views of a fourth preferred embodiment 130 of a cleat according to the present invention in which traction elements 1342 include turf-engaging portions 1344 resembling triangular or trapezoidal prisms having a substantially equilateral triangular cross section. Each turf-engaging portion 1344 preferably is attached to central hub 1341 by a preferably flexible arm 1343. A threaded stud or shaft (not shown), for attachment to a suitable receptacle in an athletic shoe, is formed either integrally with, or separately from but attached to, cleat 130, or a screw may be inserted through hole 131 to attach cleat 130 to a shoe.

Figure 16:
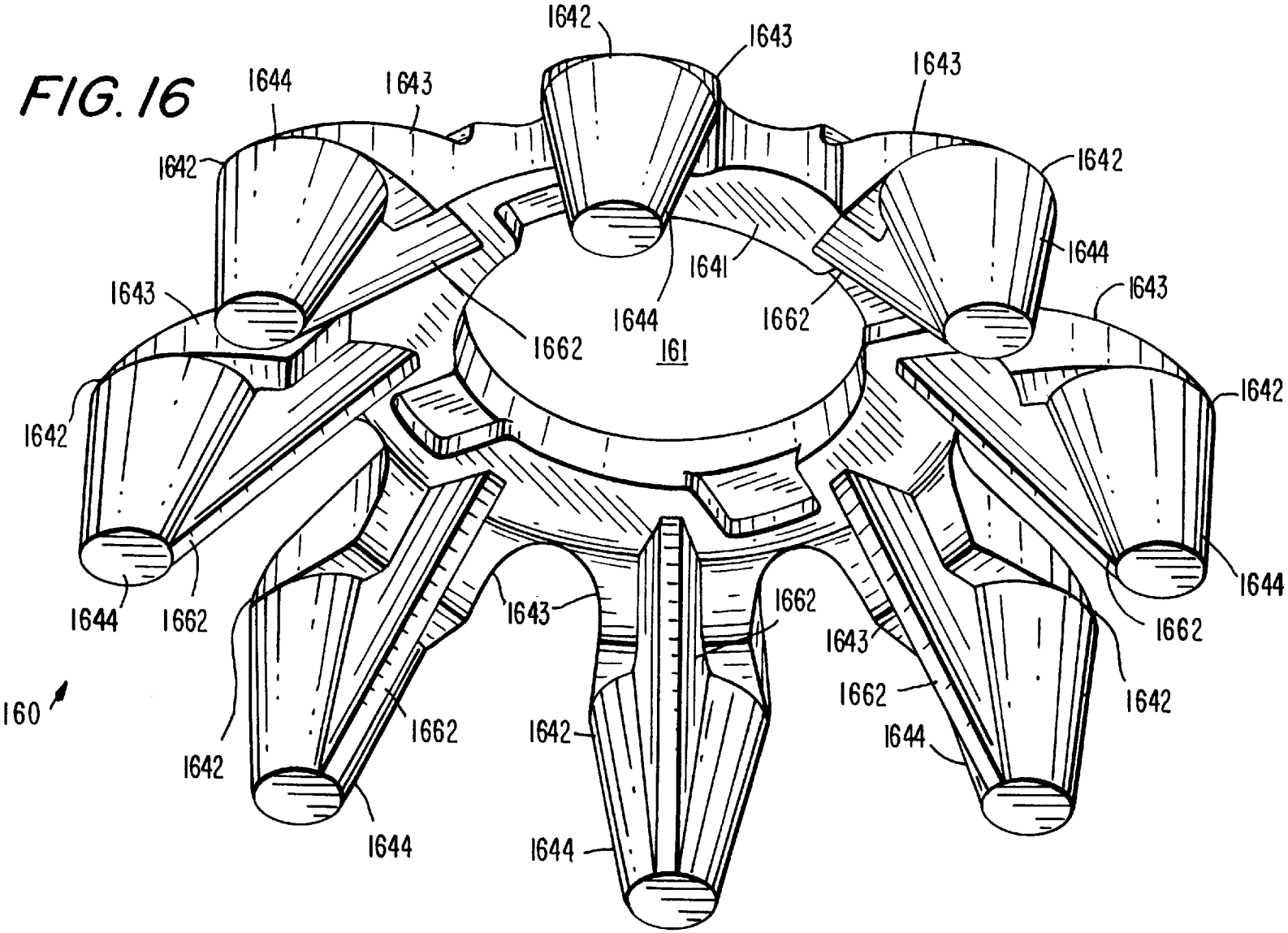
FIG. 16 is a bottom perspective view of a fifth preferred embodiment of a cleat according to the present invention.
Figure 17:
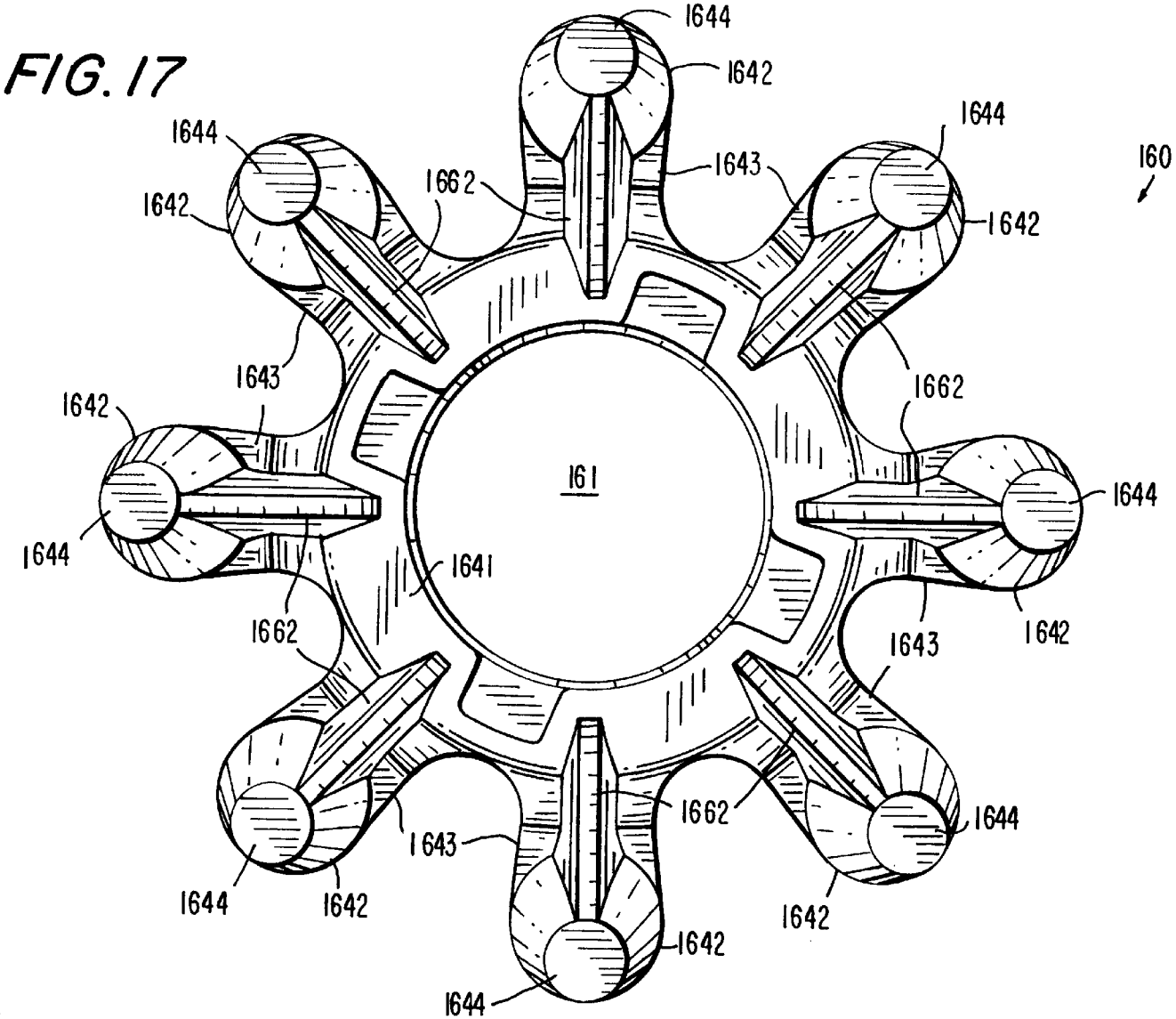
FIG. 17 is a bottom plan view of the cleat of FIG. 16.
Figure 18:
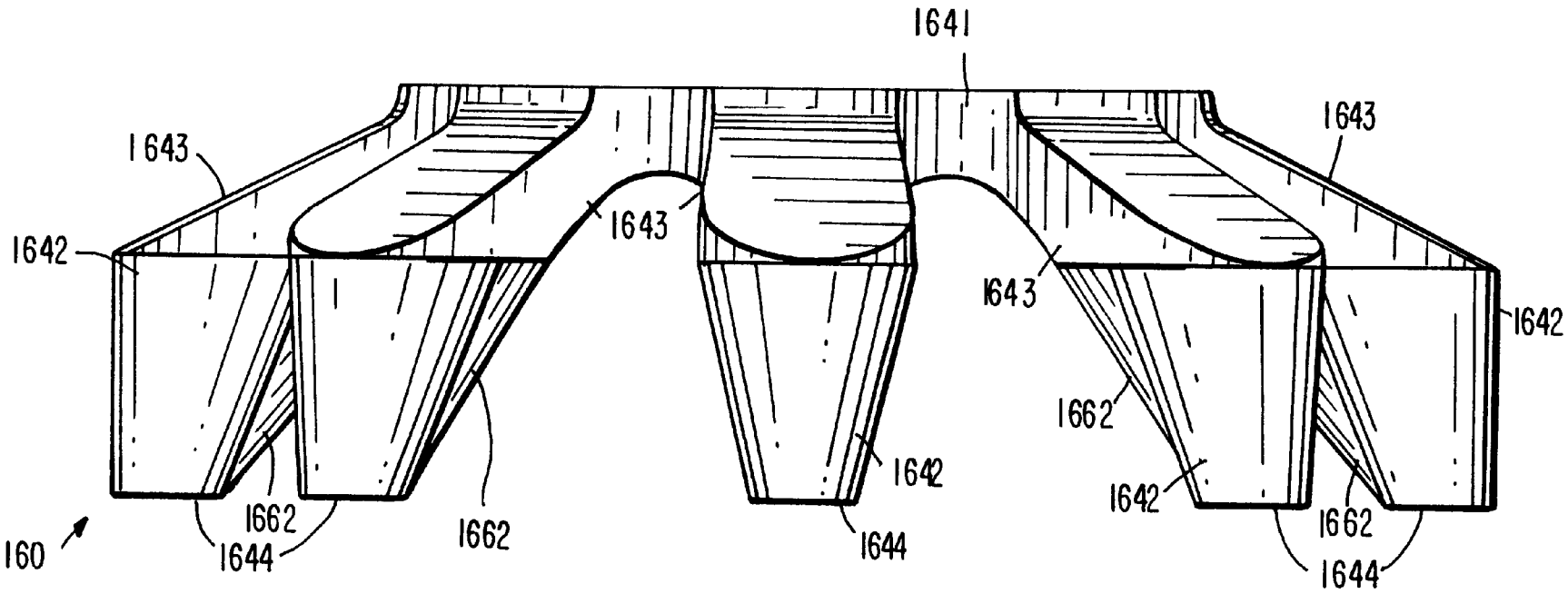
FIG. 18 is a side elevational view of the cleat of FIGS. 16 and 17.

FIGS. 16–18 are, respectively, top perspective, top plan, and side elevational views of a fifth preferred embodiment 160 of a cleat according to the present invention in which turf-engaging portions 1644 of traction elements 1642 are substantially frustoconical. Each turf-engaging portion 1644 preferably is attached to central hub 1641 by a preferably flexible arm 1643, reinforced by gusset 1662 between turf-engaging portion 1644 and arm 1643. A threaded stud or shaft (not shown), for attachment to a suitable receptacle in an athletic shoe, is formed either integrally with, or separately from but attached to, cleat 160, or a screw may be inserted through hole 161 to attach cleat 160 to a shoe.

Figure 19:
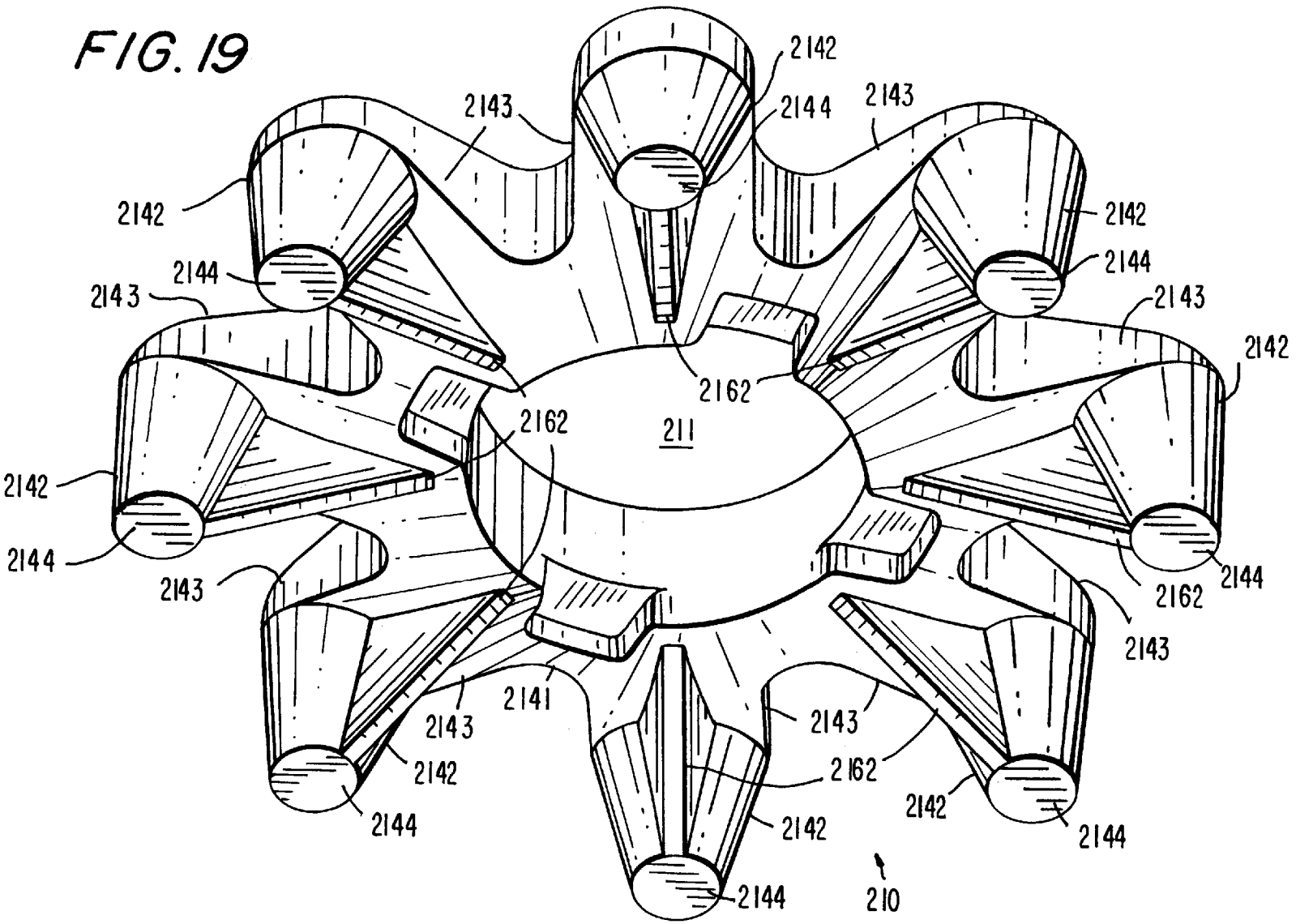
FIG. 19 is a bottom perspective view of a sixth preferred embodiment of a cleat according to the present invention.
Figure 20:
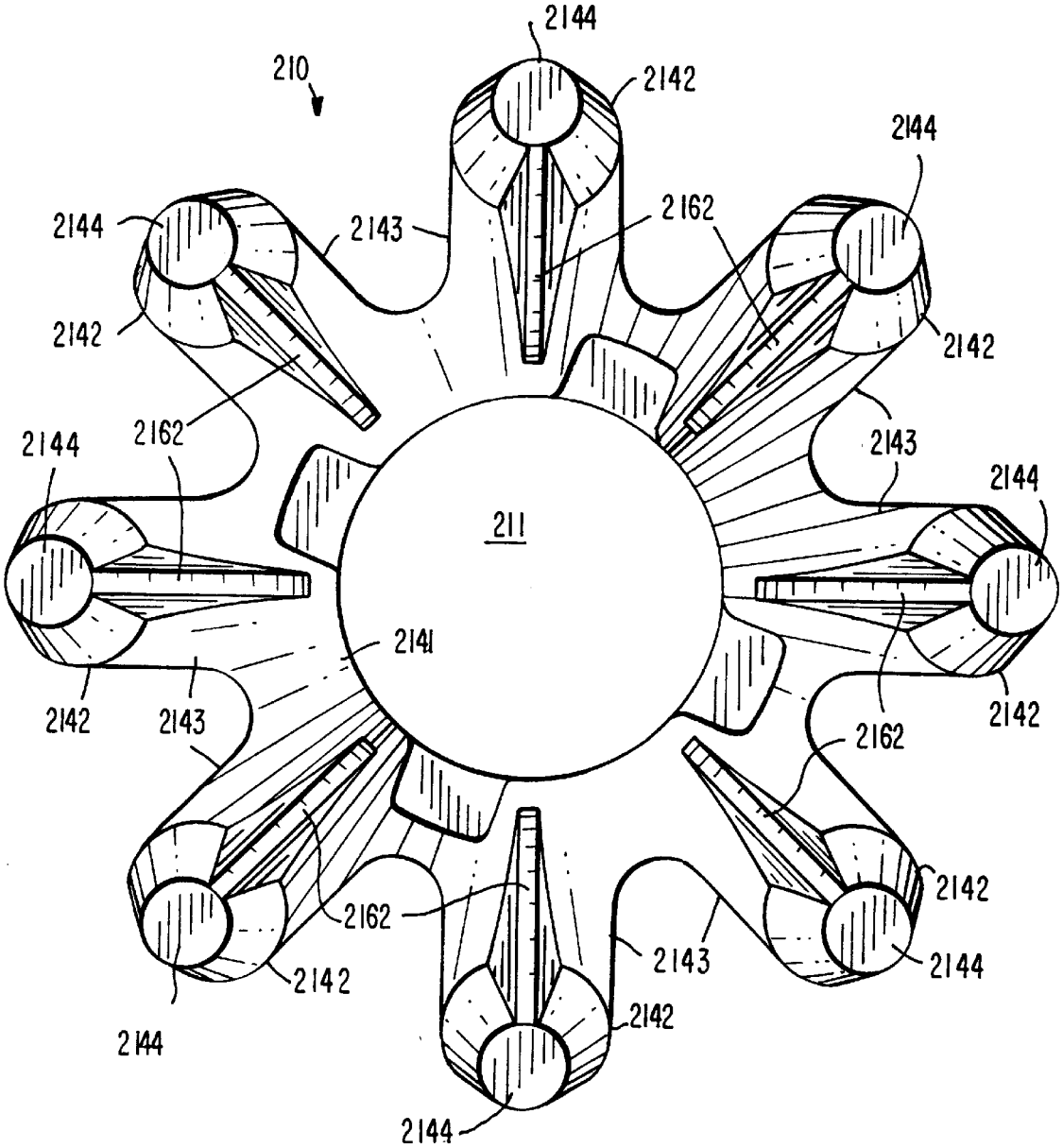
FIG. 20 is a bottom plan view of the cleat of FIG. 19.
Figure 21:
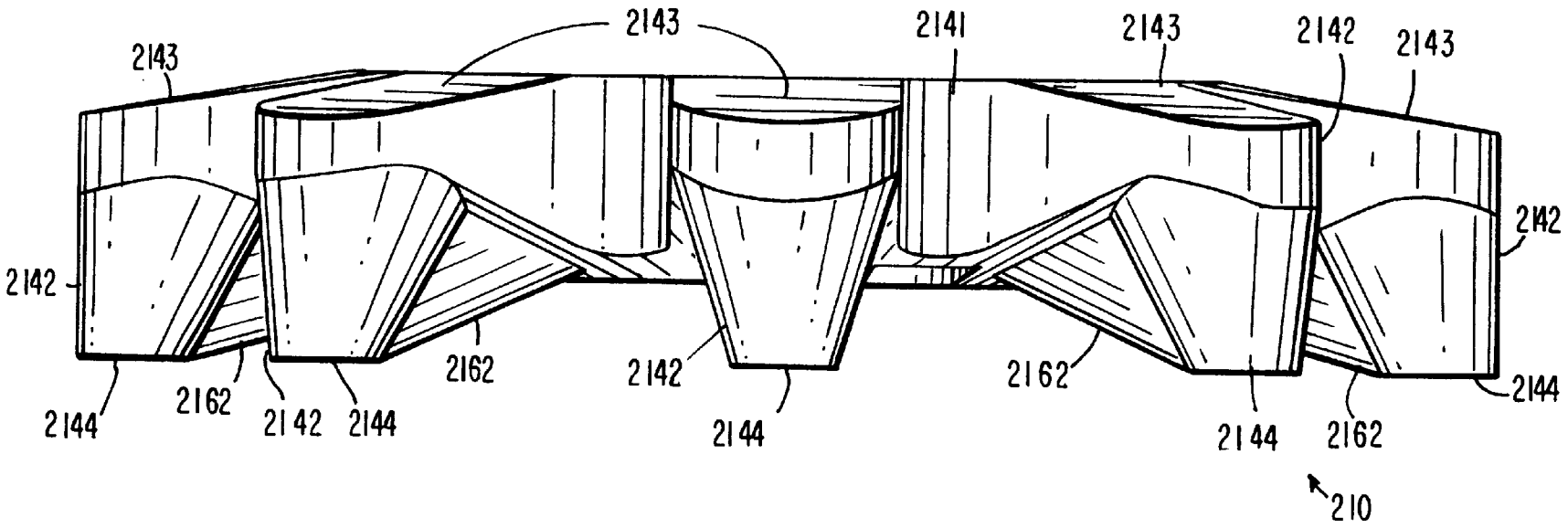
FIG. 21 is a side elevational view of the cleat of FIGS. 19 and 20.

FIGS. 19–21 are, respectively, top perspective, top plan, and side elevational views of a sixth preferred embodiment 210 of a cleat according to the present invention, which is similar to cleat 160, but in which arms 2143 do not angle away as much from the plane of hub 2141 as do arms 1643 from the plane of hub 1641. A threaded stud or shaft (not shown), for attachment to a suitable receptacle in an athletic shoe, is formed either integrally with, or separately from but attached to, cleat 210, or a screw may be inserted through hole 211 to attach cleat 210 to a shoe.

Figure 22:
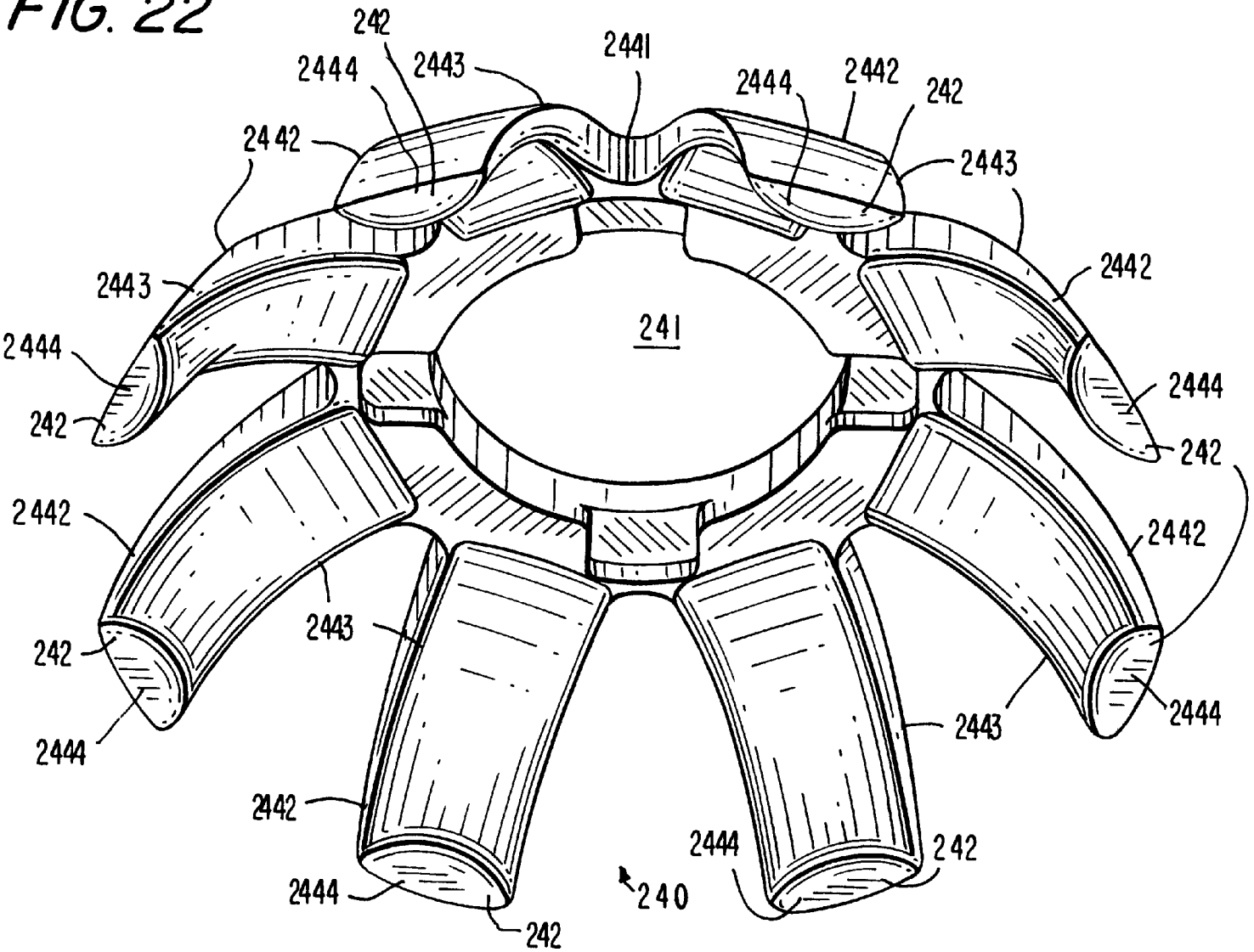
FIG. 22 is a bottom perspective view of a seventh preferred embodiment of a cleat according to the present invention.
Figure 23:
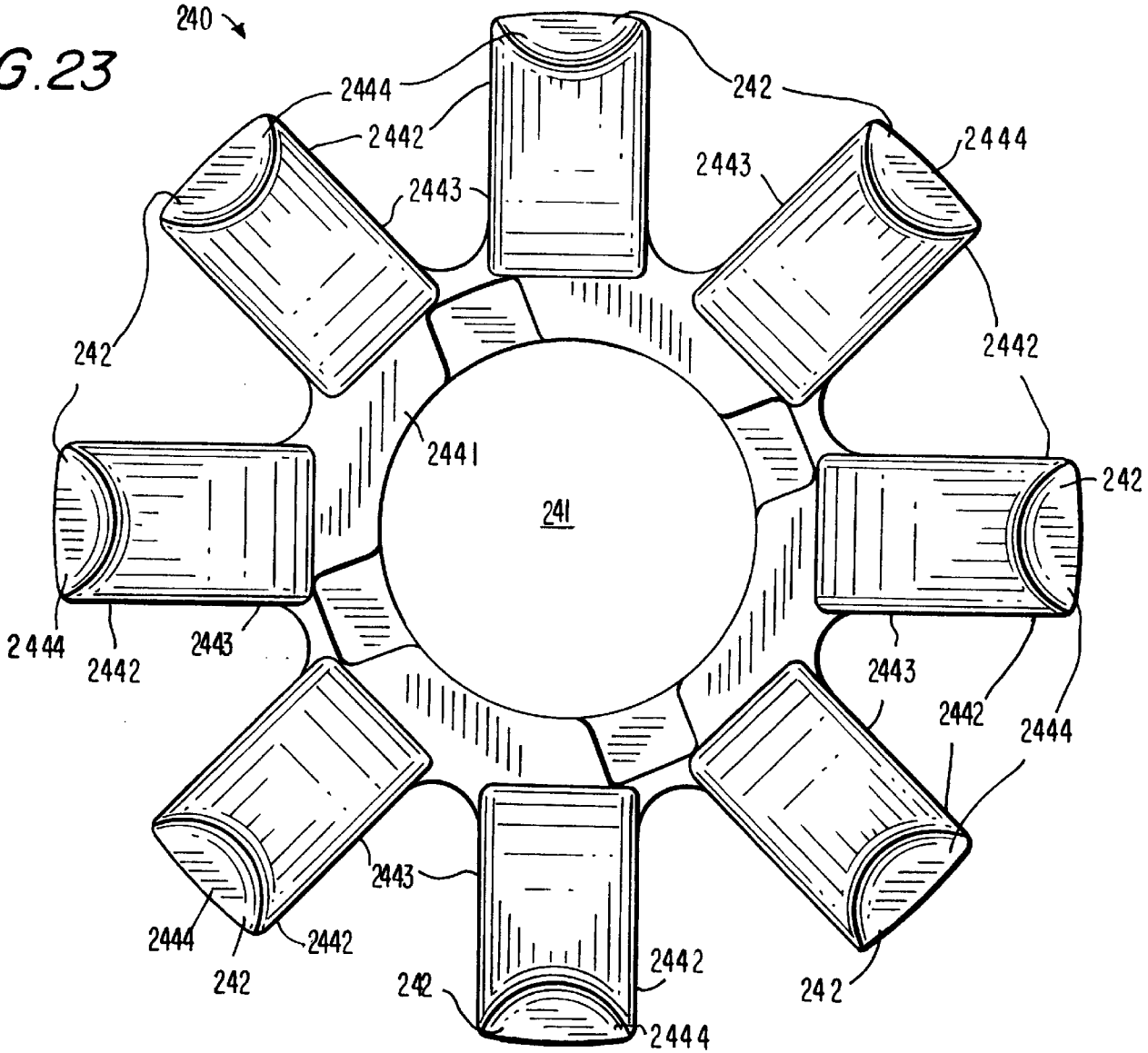
FIG. 23 is a bottom plan view of the cleat of FIG. 22.
Figure 24:
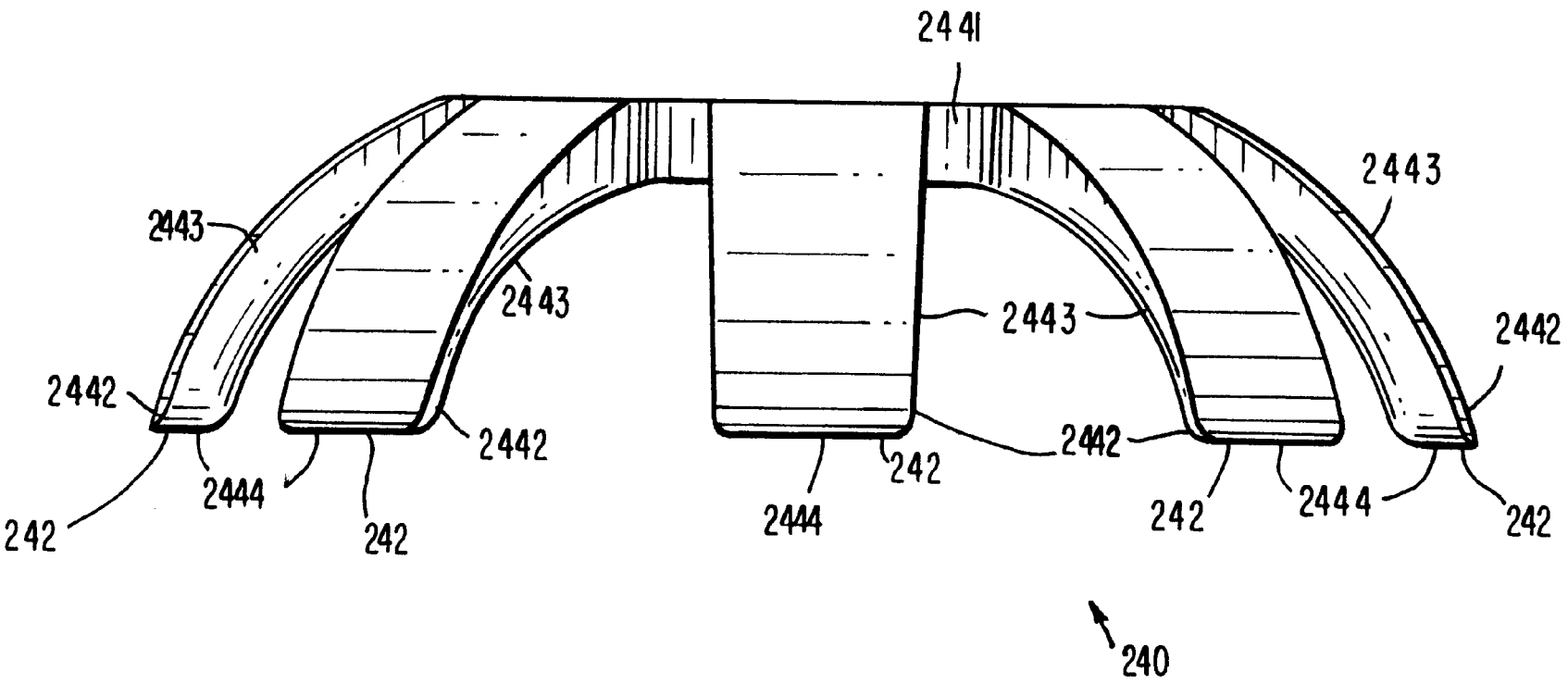
FIG. 24 is a side elevational view of the cleat of FIGS. 22 and 23.

FIGS. 22–24 are, respectively, top perspective, top plan, and side elevational views of a seventh preferred embodiment 240 of a cleat according to the present invention in which turf-engaging portions 2444 of traction elements 2442 are substantially semicylindrical at their tips 242. Each turf-engaging portion 2444 preferably is attached to central hub 2441 by a preferably flexible arm 2443 that preferably is substantially curved out of the plane of hub 2441. It will be noted that in this embodiment portion 2444 is integral with arm 2443 rather than being a distinct portion. A threaded stud or shaft (not shown), for attachment to a suitable receptacle in an athletic shoe, is formed either integrally with, or separately from but attached to, cleat 240, or a screw may be inserted through hole 241 to attach cleat 240 to a shoe.

Like cleat 40, each of cleats 70, 100, 130, 160, 210 and 240 is preferably molded as a unitary body (either with or without the threaded stud or shaft), preferably from a flexible, durable elastomeric material such as polyurethane. Alternatively, however, again like cleat 40, each of cleats 70, 100, 130, 160, 210 and 240 could be molded as two or more separate parts (not shown), which are then fastened together, preferably in such a way that they cannot be separated. As a further alternative, like cleat 40, each of cleats 70, 100, 130, 160, 210 and 240 could be a comolding of two separate materials.

Figure 25:
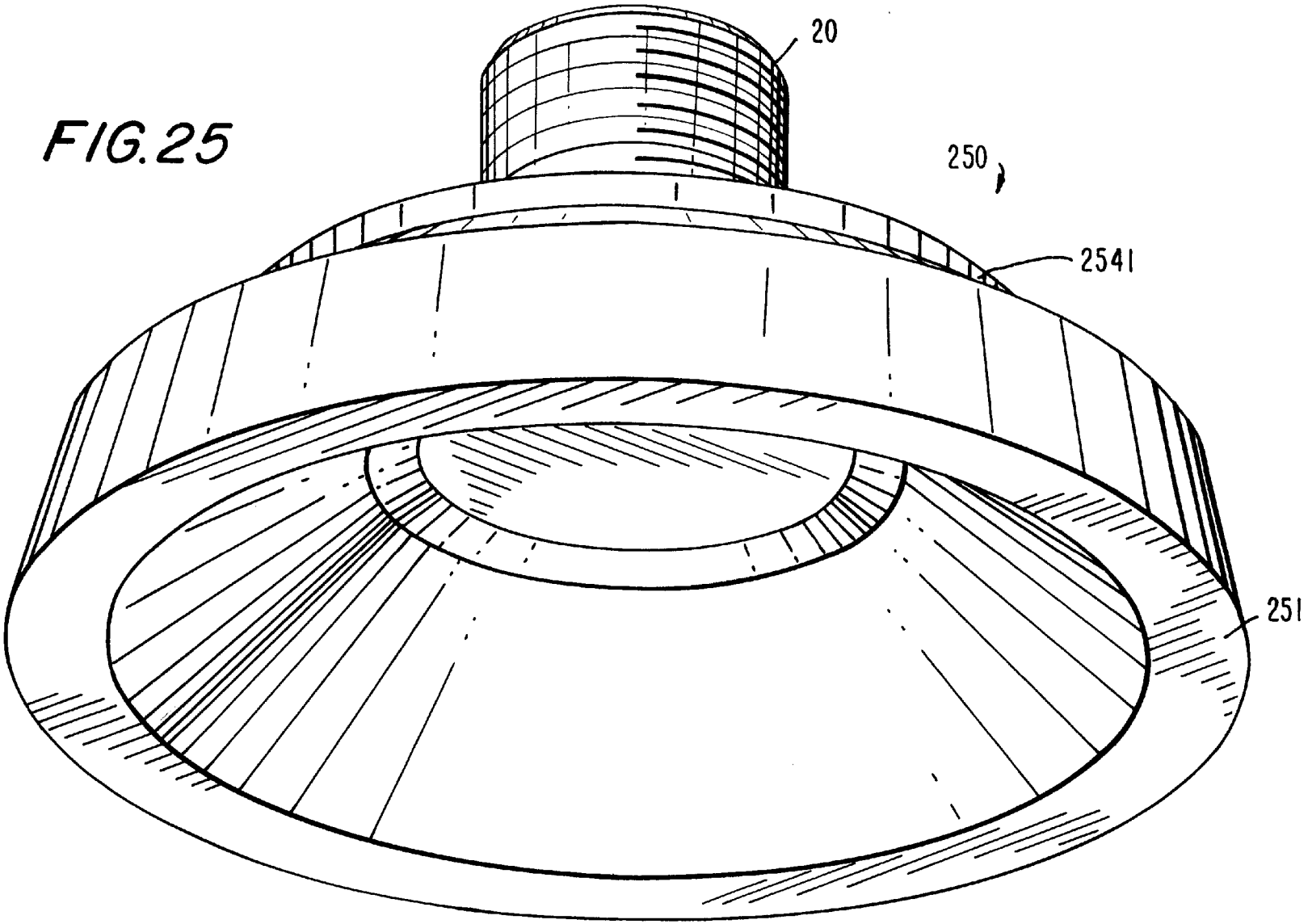
FIG. 25 is a bottom perspective view of an eighth preferred embodiment of a cleat according to the present invention.
Figure 26:
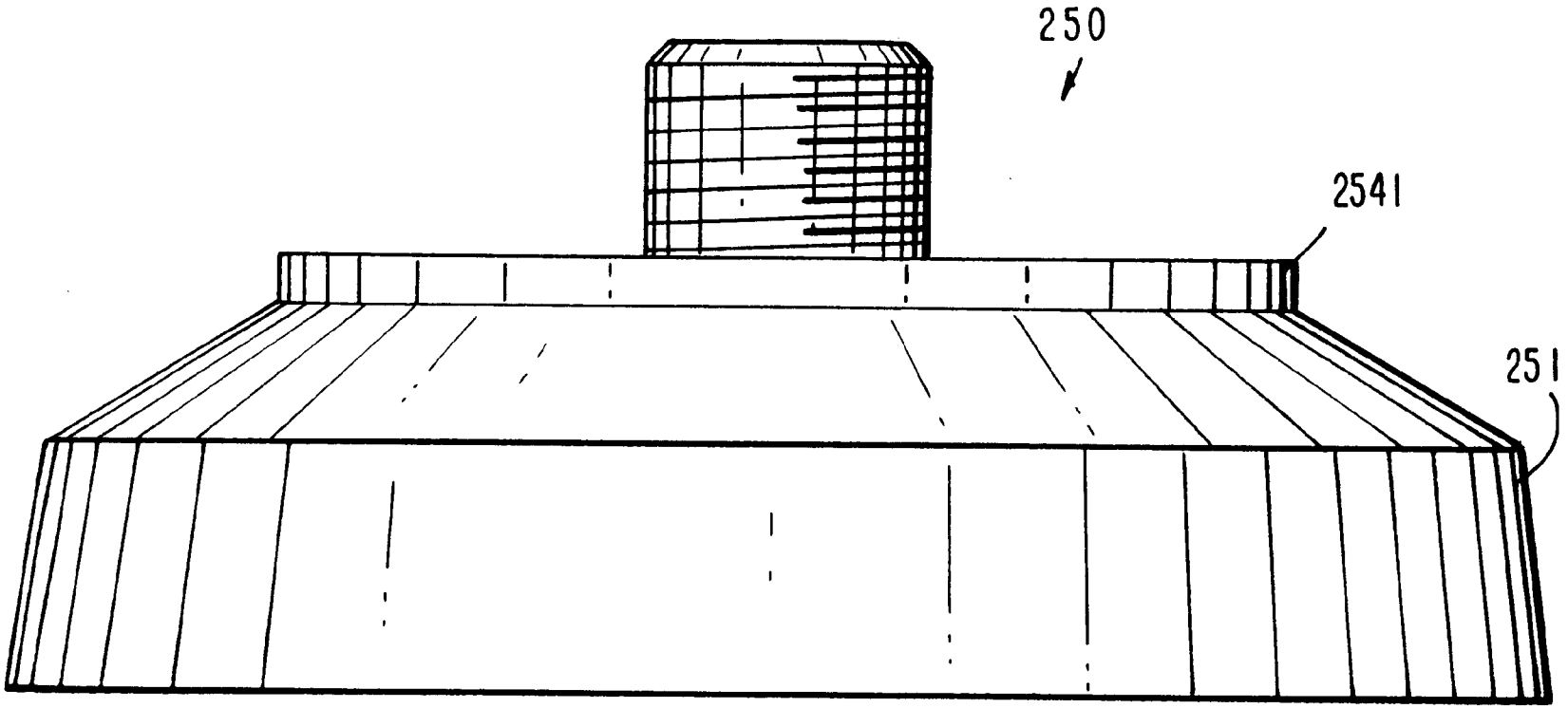
FIG. 26 is a side elevational view of the cleat of FIG. 25.

While each of the cleats shown in FIGS. 1–24 has a plurality of traction elements, an eighth preferred embodiment 250 of a cleat according to the present invention is shown in FIGS. 25 and 26. Cleat 250 has a single cantilevered traction element in the form of a preferably continuous flange 251 cantilevered from hub 2541. Flange 251 preferably has the appearance of a truncated cone, and may further have a depending skirt (not shown), preferably substantially perpendicular to hub 2541. Flange 251 preferably is made from a material sufficiently resilient to allow all of flange 251 to be deflected toward the plane of hub 2541 without damaging flange 251. Moreover, flange 251 may be cut radially (not shown) to form a plurality of separate, but contiguous, traction elements. In addition, flange 251 may extend less than completely around hub 2541, and there may be other embodiments within the invention having only a single traction element.

Figure 27:
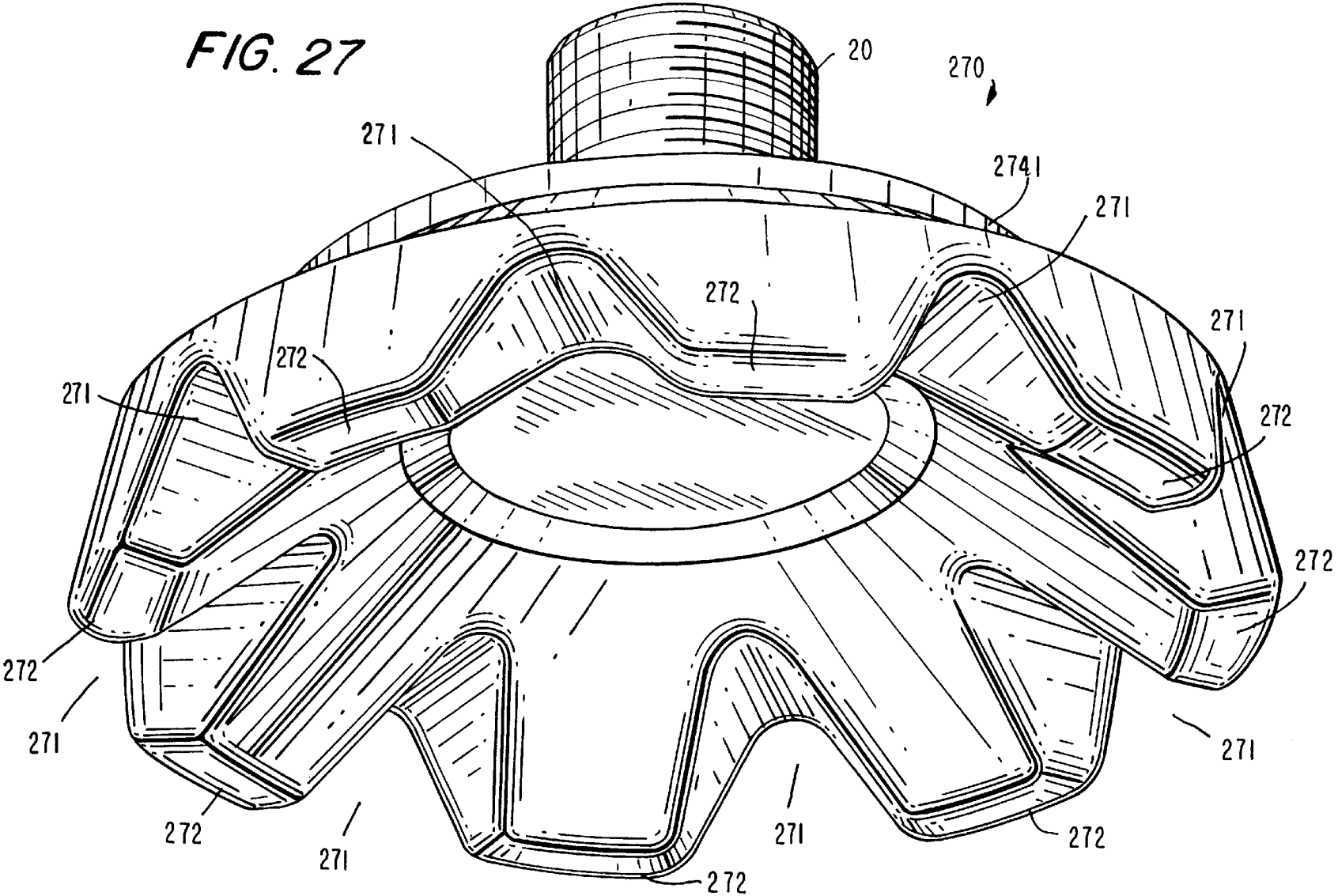
FIG. 27 is a bottom perspective view of an ninth preferred embodiment of a cleat according to the present invention.
Figure 28:
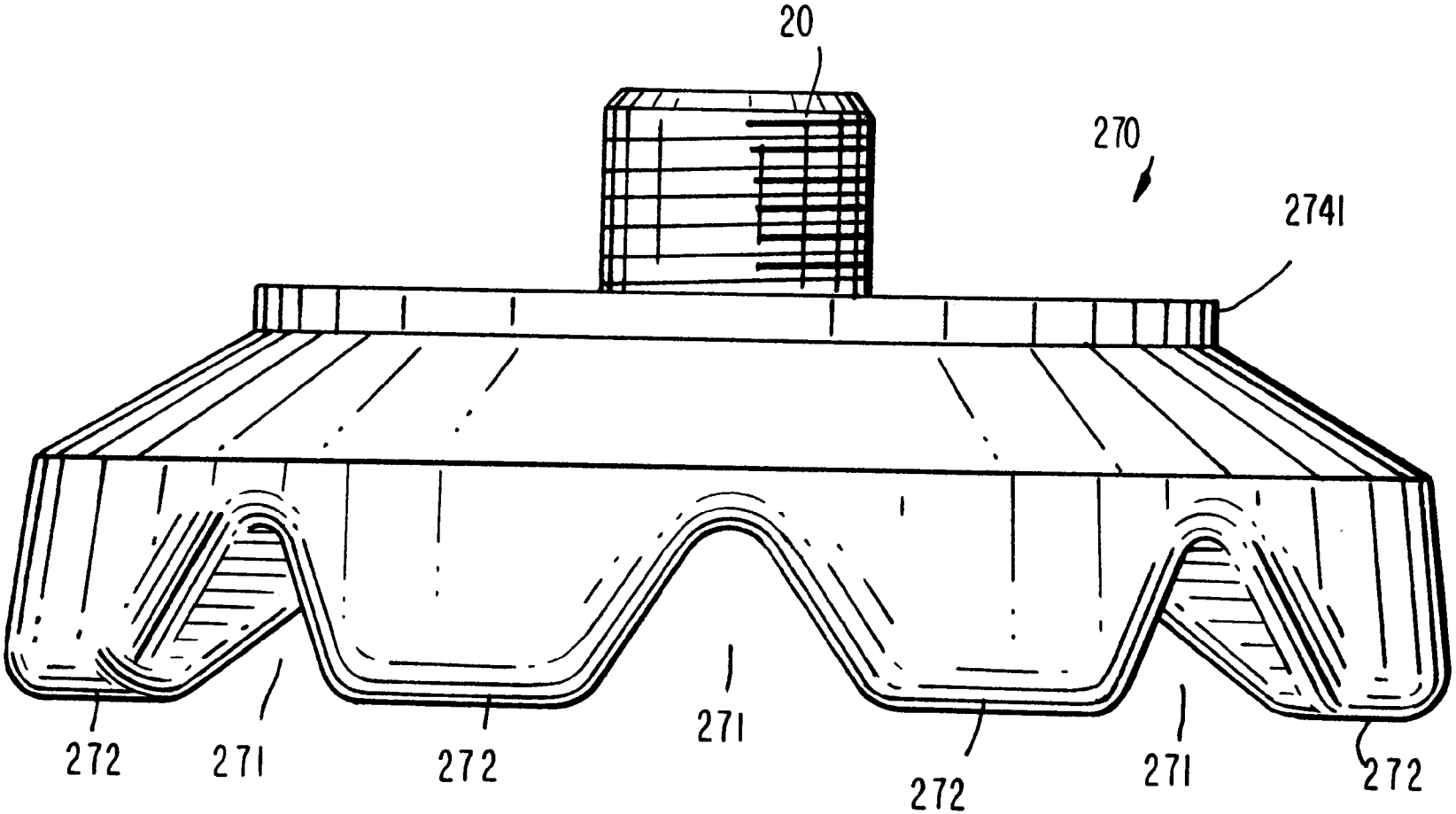
FIG. 28 is a side elevational view of the cleat of FIG. 25.

A ninth preferred embodiment 270 of a cleat according to the present invention is shown in FIGS. 27 and 28. Cleat 270 is derived from cleat 250 by removing substantially triangular portions 271 from flange 251, creating a plurality of non-contiguous traction elements 272 extending from hub 2741, as opposed to merely cutting flange 251 as described (but not shown) above to create contiguous traction elements.

Thus it is seen that an athletic shoe cleat having traction elements whose abrasion when worn on hard surfaces is minimized, yet which provides enhanced traction, has been provided. One skilled in the art will appreciate that the present invention can be practiced by other than the described embodiments, which are presented for purposes of illustration and not of limitation, and the present invention is limited only by the claims which follow.

What is claimed is:

1. A removable cleat for use with an athletic shoe for providing to a user traction on a turf surface, said athletic shoe having a sole, said sole having a plurality of sole attachment means for attachment of removable cleats, said removable cleat comprising:

a hub having a perimeter, a first side facing said sole and a second side facing away from said sole;

hub attachment means extending from said first side for attaching said hub to one of said sole attachment means;

a plurality of traction elements, each of said traction elements extending substantially laterally substantially from said perimeter of said hub and having a turf-engaging portion projecting away from, and substantially perpendicularly to, said second side of said hub for engagement with turf blades to provide traction without puncturing turf; and a respective gusset extending from each respective traction element toward said hub;

said traction element being deflectably attached substantially to said perimeter of said hub so that said turf-engaging portion deflects when it encounters a hard surface, to minimize wear of said turf-engaging portion by said hard surface.

2. The removable cleat of claim 1 wherein:

each of said traction elements comprises an arm extending substantially laterally from said perimeter of said hub; and said turf-engaging portion is attached to said arm.

3. The removable cleat of claim 2 wherein said arm is resilient, said turf-engaging portions being deflectably attached substantially to said perimeter of said hub by virtue of said arm being resilient.

4. The removable cleat of claim 2 wherein said arm extends away from said second side of said hub, such that when said removable cleat is attached to a shoe sole, said arm is cantilevered away from said shoe sole.

5. The removable cleat of claim 4 wherein said arm is substantially resilient, whereby when said removable cleat is used on a hard surface, said arm deflects toward said shoe sole.

6. The removable cleat of claim 2 wherein said respective gusset extends between said turf-engaging portion and said arm.

7. The removable cleat of claim 6 wherein said gusset extends between said turf-engaging portion and said arm in a direction toward said hub.

8. The removable cleat of claim 6 wherein said gusset is resilient.

9. The removable cleat of claim 2 wherein said hub, said arm and said turf-engaging portion are made from a single material.

10. The removable cleat of claim 9 wherein said single material is substantially resilient.

11. The removable cleat of claim 2 wherein said hub and said arm are made from a first material and at least a portion of said turf-engaging portion is made from a second material more resistant to abrasion than said first material.

12. The removable cleat of claim 11 wherein said turf-engaging portion has a tip for engaging said turf blades and said tip is made from said second material.

13. The removable cleat of claim 12 wherein said turf-engaging portion is made substantially entirely from said second material.

14. The removable cleat of claim 1 wherein said gusset is resilient.

15. The removable cleat of claim 1 wherein said hub and said at least one traction element are made from a single material.

16. The removable cleat of claim 15 wherein said single material is substantially resilient.

17. The removable cleat of claim 1 wherein said hub is made from a first material and at least a portion of said at least one traction element is made from a second material more resistant to abrasion than said first material.

18. The removable cleat of claim 17 wherein said at least one traction element has a tip for engaging said turf blades and said tip is made from said second material.

19. The removable cleat of claim 18 wherein said at least one traction element is made substantially entirely from said second material.

20. An athletic shoe comprising:

a sole;

a plurality of sole attachment means on said sole for attachment of removable cleats; and a plurality of removable cleats for use with said athletic shoe for providing to a user traction on a turf surface, said removable cleat comprising:

a hub having a perimeter, a first side facing said sole and a second side facing away from said sole, hub attachment means extending from said first side for attaching said hub to one of said sole attachment means, a plurality of traction elements, each of said traction elements extending substantially laterally substantially from said perimeter of said hub and having a turf-engaging portion projecting away from, and substantially perpendicularly to, said second side of said hub for engagement with turf blades to provide traction without puncturing turf, and a respective gusset extending from each respective traction element toward said hub, said traction element being deflectably attached substantially to said perimeter of said hub so that said turf-engaging portion deflects when it encounters a hard surface, to minimize wear of said turf-engaging portion by said hard surface.

21. The athletic shoe of claim 20 wherein:

each of said traction elements comprises an arm extending substantially laterally from said perimeter of said hub; and said turf-engaging portion is attached to said arm.

22. The athletic shoe of claim 21 wherein said arm is resilient, said turf-engaging portions being deflectably attached substantially to said perimeter of said hub by virtue of said arm being resilient.

23. The athletic shoe of claim 21 wherein said arm extends away from said second side of said hub, such that when said removable cleat is attached to said shoe sole, said arm is cantilevered away from said shoe sole.

24. The athletic shoe of claim 23 wherein said arm is substantially resilient, whereby when said removable cleat is used on a hard surface, said arm deflects toward said shoe sole.

25. The athletic shoe of claim 21 wherein said respective gusset extends between said turf-engaging portion and said arm.

26. The athletic shoe of claim 25 wherein said gusset extends between said turf-engaging portion and said arm in a direction toward said hub.

27. The athletic shoe of claim 25 wherein said gusset is resilient.

28. The athletic shoe of claim 21 wherein said hub, said arm and said turf-engaging portion are made from a single material.

29. The athletic shoe of claim 28 wherein said single material is substantially resilient.

30. The athletic shoe of claim 21 wherein said hub and said arm are made from a first material and at least a portion of said turf-engaging portion is made from a second material more resistant to abrasion than said first material.

31. The athletic shoe of claim 30 wherein said turf-engaging portion has a tip for engaging said turf blades and said tip is made from said second material.

32. The athletic shoe of claim 31 wherein said turf-engaging portion is made substantially entirely from said second material.

33. The athletic shoe of claim 20 wherein said gusset is resilient.

34. The athletic shoe of claim 20 wherein said hub and said at least one traction element are made from a single material.

35. The athletic shoe of claim 34 wherein said single material is substantially resilient.

36. The athletic shoe of claim 20 wherein said hub is made from a first material and at least a portion of said at least one traction element is made from a second material more resistant to abrasion than said first material.

37. The athletic shoe of claim 36 wherein said at least one traction element has a tip for engaging said turf blades and said tip is made from said second material.

38. The athletic shoe of claim 37 wherein said at least one traction element is made substantially entirely from said second material.

* * * * *